US008192911B2

(12) United States Patent
Awamura et al.

(10) Patent No.: US 8,192,911 B2
(45) Date of Patent: Jun. 5, 2012

(54) METHOD OF MANUFACTURING TONER AND TONER

(75) Inventors: Junichi Awamura, Numazu (JP); Akinori Saitoh, Numazu (JP); Osamu Uchinokura, Mishima (JP); Masahide Yamada, Numazu (JP); Tomomi Suzuki, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 542 days.

(21) Appl. No.: 12/437,565

(22) Filed: May 8, 2009

(65) Prior Publication Data

US 2009/0280421 A1 Nov. 12, 2009

(30) Foreign Application Priority Data

May 8, 2008 (JP) ..... 2008-121840

(51) Int. Cl.
*G03G 9/08* (2006.01)

(52) U.S. Cl. ..... 430/137.1; 430/137.14; 430/137.19

(58) Field of Classification Search ..... 430/137.1, 430/137.14, 137.19
See application file for complete search history.

(56) References Cited

U.S. PATENT DOCUMENTS

| | | | |
|---|---|---|---|
| 5,403,690 | A | 4/1995 | Kuramoto et al. |
| 5,554,478 | A | 9/1996 | Kuramoto et al. |
| 5,840,456 | A | 11/1998 | Tomita et al. |
| 6,074,794 | A | 6/2000 | Fushimi et al. |
| 6,303,258 | B1 | 10/2001 | Katoh et al. |
| 6,360,068 | B1 | 3/2002 | Kinoshita et al. |
| 6,406,826 | B1 | 6/2002 | Suzuki et al. |
| 6,416,914 | B1 | 7/2002 | Nakamura et al. |
| 6,432,589 | B1 | 8/2002 | Uchinokura et al. |
| 6,432,590 | B1 | 8/2002 | Ueda et al. |
| 6,479,204 | B1 | 11/2002 | Uchinokura et al. |
| 6,500,595 | B1 | 12/2002 | Mochizuki et al. |
| 6,503,676 | B2 | 1/2003 | Yamashita et al. |
| 6,641,969 | B2 | 11/2003 | Uchinokura et al. |
| 6,733,939 | B2 | 5/2004 | Nanya et al. |
| 6,737,210 | B2 | 5/2004 | Uchinokura et al. |
| 6,757,507 | B2 | 6/2004 | Mochizuki et al. |
| 6,770,411 | B2 | 8/2004 | Masuda et al. |
| 6,818,369 | B2 | 11/2004 | Sugiura et al. |
| 6,818,370 | B2 | 11/2004 | Uchinokura et al. |
| 6,828,075 | B2 | 12/2004 | Suzuki et al. |
| 6,855,468 | B1 | 2/2005 | Yamamoto et al. |
| 6,861,191 | B2 | 3/2005 | Mochizuki et al. |
| 6,902,857 | B2 | 6/2005 | Yagi et al. |

(Continued)

FOREIGN PATENT DOCUMENTS

JP 03-015858 1/1991

(Continued)

OTHER PUBLICATIONS

U.S. Appl. No. 12/428,493, filed Apr. 23, 2009, Awamura, et al.

(Continued)

*Primary Examiner* — Hoa V Le
(74) *Attorney, Agent, or Firm* — Oblon, Spivak, McClelland, Maier & Neustadt, L.L.P.

(57) ABSTRACT

A method of manufacturing a toner including dispersing a binder resin, a coloring agent and a releasing agent in an organic solvent to obtain an oil phase; dispersing the oil phase in an aqueous medium with a shearing force to obtain a dispersion emulsion; wherein the shearing force is made by a screen or vessel that is situated around a rotor, the screen spinning in a direction opposite to the direction that the rotor spins. Toner produced. Method of using the toner.

18 Claims, 5 Drawing Sheets

U.S. PATENT DOCUMENTS

| | | | |
|---|---|---|---|
| 6,902,858 | B2 | 6/2005 | Mochizuki et al. |
| 6,916,587 | B2 | 7/2005 | Fushimi et al. |
| 7,024,140 | B2 | 4/2006 | Masuda et al. |
| 7,083,890 | B2 | 8/2006 | Emoto et al. |
| 7,129,013 | B2 | 10/2006 | Higuchi et al. |
| 7,169,522 | B2 | 1/2007 | Sugiura et al. |
| 7,258,959 | B2 | 8/2007 | Nakayama et al. |
| 7,300,736 | B2 | 11/2007 | Fushimi et al. |
| 7,318,989 | B2 | 1/2008 | Kotsugai et al. |
| 7,344,812 | B2 | 3/2008 | Suzuki et al. |
| 7,348,117 | B2 | 3/2008 | Inoue et al. |
| 7,348,121 | B2 | 3/2008 | Inoue et al. |
| 7,368,213 | B2 | 5/2008 | Nakayama et al. |
| 7,374,848 | B2 | 5/2008 | Matsuoka et al. |
| 7,374,851 | B2 | 5/2008 | Nakayama et al. |
| 7,429,442 | B2 | 9/2008 | Honda et al. |
| 7,437,111 | B2 | 10/2008 | Yamada et al. |
| 7,442,484 | B2 | 10/2008 | Uchinokura et al. |
| 7,449,273 | B2 | 11/2008 | Ohki et al. |
| 7,455,942 | B2 | 11/2008 | Nagatomo et al. |
| 7,459,255 | B2 | 12/2008 | Tanaka et al. |
| 7,473,508 | B2 | 1/2009 | Higuchi et al. |
| 7,488,564 | B2 | 2/2009 | Tanaka et al. |
| 7,504,188 | B2 | 3/2009 | Yamada et al. |
| 7,521,164 | B2 | 4/2009 | Nakayama et al. |
| 2005/0089786 | A1 | 4/2005 | Sugiura et al. |
| 2005/0112488 | A1 | 5/2005 | Yamada et al. |
| 2005/0164112 | A1 | 7/2005 | Ohki et al. |
| 2005/0208408 | A1 | 9/2005 | Uchinokura et al. |
| 2006/0024097 | A1 | 2/2006 | Yamada et al. |
| 2006/0029433 | A1 | 2/2006 | Saito et al. |
| 2006/0057488 | A1 | 3/2006 | Inoue et al. |
| 2006/0068312 | A1 | 3/2006 | Yamashita et al. |
| 2006/0160011 | A1 | 7/2006 | Inoue et al. |
| 2006/0210903 | A1 | 9/2006 | Ohki et al. |
| 2006/0251979 | A1 | 11/2006 | Watanabe et al. |
| 2007/0054210 | A1 | 3/2007 | Ohki et al. |
| 2007/0059626 | A1 | 3/2007 | Inoue et al. |
| 2007/0134581 | A1 | 6/2007 | Uchinokura et al. |
| 2007/0218380 | A1 | 9/2007 | Uchinokura et al. |
| 2007/0218381 | A1 | 9/2007 | Uchinokura et al. |
| 2007/0218382 | A1 | 9/2007 | Emoto et al. |
| 2007/0218383 | A1 | 9/2007 | Seshita et al. |
| 2007/0218385 | A1 | 9/2007 | Kojima et al. |
| 2007/0218389 | A1 | 9/2007 | Honda et al. |
| 2007/0218391 | A1 | 9/2007 | Yamada et al. |
| 2007/0218392 | A1 | 9/2007 | Yamada et al. |
| 2008/0014527 | A1 | 1/2008 | Kotsugai et al. |
| 2008/0069616 | A1 | 3/2008 | Kojima et al. |
| 2008/0070144 | A1 | 3/2008 | Nagatomo et al. |
| 2008/0070148 | A1 | 3/2008 | Awamura et al. |
| 2008/0076055 | A1 | 3/2008 | Sawada et al. |
| 2008/0213682 | A1 | 9/2008 | Saitoh et al. |
| 2008/0227015 | A1 | 9/2008 | Nagatomo et al. |
| 2008/0227018 | A1 | 9/2008 | Awamura et al. |
| 2008/0233505 | A1 | 9/2008 | Nagatomo et al. |
| 2008/0280218 | A1 | 11/2008 | Sabu et al. |
| 2008/0280219 | A1 | 11/2008 | Nakayama et al. |
| 2008/0292361 | A1 | 11/2008 | Seshita et al. |
| 2008/0311500 | A1 | 12/2008 | Yamada et al. |
| 2009/0010687 | A1 | 1/2009 | Yamada et al. |
| 2009/0017392 | A1 | 1/2009 | Higuchi et al. |
| 2009/0061345 | A1 | 3/2009 | Yamada et al. |
| 2009/0067876 | A1 | 3/2009 | Seshita et al. |

FOREIGN PATENT DOCUMENTS

| | | |
|---|---|---|
| JP | 04-114725 | 4/1992 |
| JP | 09-311502 | 12/1997 |
| JP | 2002-006541 | 1/2002 |
| JP | 2004-226669 | 8/2004 |
| JP | 2004-246345 | 9/2004 |
| JP | 2006-139161 | 6/2006 |

OTHER PUBLICATIONS

U.S. Appl. No. 12/091,301, filed Apr. 24, 2008, Sugiura, et al.
U.S. Appl. No. 12/282,075, filed Sep. 25, 2008, Watanabe, et al.
U.S. Appl. No. 12/271,406, filed Nov. 14, 2008, Sawada, et, al.
U.S. Appl. No. 12/260,493, filed Oct. 29, 2008, Sawada, et, al.
U.S. Appl. No. 12/271,257, filed Nov. 14, 2008, Shimota, et al.
U.S. Appl. No. 12/324,995, filed Nov. 28, 2008, Awamura, et al.
U.S. Appl. No. 12/325,660, filed Dec. 1, 2008, Saitoh, et al.
U.S. Appl. No. 12/343,574, filed Dec. 24, 2008, Yamada, et al.

METHOD OF MANUFACTURING TONER AND TONER

BACKGROUND OF THE INVENTION

1. Field of the Invention

The present invention relates to a method of manufacturing a toner. In addition, the present invention also relates to a toner and its method of use.

2. Discussion of the Background

In recent years, demand for quality images from the market has spurred development of many electrophotographic apparatuses and developing agents including toner for use therein. Toner capable of producing quality images is required to have a sharp particle size distribution. Toner particles of toner having a sharp particle size distribution behave by keeping with each other during development, which improves minute dot reproducibility.

Toners (chemical toner) have been developed based on a suspension polymerization method or emulsification polymerization agglomeration methods in which toner particles are granulated in an aqueous phase to achieve the goal described above.

In the suspension polymerization method, toner particles are prepared from oil droplets formed by adding and stirring a monomer, a polymerization initiator, a coloring agent, a releasing agent, etc. in an aqueous phase containing a dispersion stabilizer followed by polymerization with heating. Toner particles can be reduced in size by the suspension polymerization method. However, a dispersion stabilizer is required which may degrade the chargeability due to its presence in the toner. Without a dispersion stabilizer, a releasing agent tends to be present in the oil droplet when the oil droplet is formed so that the releasing agent cannot suitably exist on the surface of obtained toner particles.

In addition, unexamined published Japanese patent application No. (hereinafter referred to as JOP) 2004-226669 describes a method in which a releasing agent particulate covered or impregnated with a vinyl polymer by adding a polymerizable vinyl monomer and a water-soluble polymerization initiator to a releasing agent emulsion for polymerization is added when a toner component is emulsified so that a particulate releasing agent is uniformly and firmly attached to the surface of toner. However, polymerization of a releasing agent emulsion and a polymerizable vinyl monomer is required in this method. Also, the glass transition temperature (Tg) of the resin forming the particulate releasing agent is high, which degrades the releasing property at a low temperature and the low temperature fixing property.

In addition, Japanese patent No. 2663016 describes a method in which a toner is manufactured by suspension-polymerization of a material having a polar group and a polymerizable monomer containing a releasing agent in an aqueous medium so that the toner can contain a wax having a low melting point not suitably used for a toner manufactured by a pulverization method. A non-polar component such as wax is not present close to the surface of toner particles contrary to the polar component so that the toner has a pseudo-capsule structure in which the surface of the toner is covered with the polar component. However, the distribution of the wax inside the toner particle is not analyzed and thus unknown.

JOP 2002-6541 describes a toner containing a wax encapsulated therein and locally present on the surface of the toner. However, the detail of the dispersion state near the surface of the toner is not described.

JOP 2004-246345 describes the ratio of a wax exposed to the surface of a toner which is measured and determined by Fourier transform infrared attenuated total reflection (FTIR-ATR). However, toner blocking and hot-offset, and filming and paper winding are completely in a trade-off relationship. Therefore, it is difficult to improve the fixing property furthermore by improvement of toner or control of the average dispersion diameter of wax.

A chemical toner can be manufactured by emulsifying a liquid phase of toner components comprising at least a resin and a coloring agent dissolved or dispersed in an organic solvent, or a liquid phase of a toner composition comprising a coloring agent dissolved or dispersed in a liquid monomer in an aqueous medium.

The volume average particle diameter (Dv value) of the toner provided by this method is smaller than the toner provided by pulverization and has a uniform particle diameter with a sharp particle diameter distribution. That means Dv/Dn value is close to 1.00 (Dn means number average of particle diameter).

The toner that satisfies these characteristics provides a high-resolution picture without picture defects or offsets, because particle diameter of the toner is uniform, so each toner also has uniform properties including amount of charge of each toner and a speed for fusion of each toner. As thus described, for providing high-resolution and high durability, a toner that satisfies a uniform particle diameter with a sharp particle diameter distribution, namely a toner where Dv/Dn is small is needed.

A chemical toner is suitable for manufacturing a uniform particle diameter having a sharp particle diameter distribution as compared to a toner prepared by pulverization. But when an emulsification condition during emulsification process is not appropriate, chemical toner that satisfies a uniform particle diameter with a sharp particle diameter distribution can't be provided. During the emulsification process, continuous emulsification facilities can be used.

JOP H09-311502 describes a technology using a mechanical shearing force as a continuous emulsification technology. JOP H09-311502 discloses a continuous mechanism, but the number of times of passing by the emulsifier or dispersion machine is only once for the disclosed continuous mechanism. The emulsifier or dispersion machine disclosed in JOP H09-311502 has turn teeth of plural steps. However, it doesn't always provide an ideal mixing ratio of a melting complex including a colorant as well as a resin and an aqueous medium on the spot where a mixture begin to be received a shearing force of the shear teeth.

Under such condition, even if the shearing force was continually as well as multiple times added, the toner particle diameter after an emulsification considerably varies as long as the mixing ratio of a melting complex including a colorant as well as a resin and an aqueous medium varies depending on the spot. It is important to repeat micro dispersion and macro mixture to emulsify a melting complex including a colorant and a resin together with an aqueous medium.

For a method based on this way of thinking, there is a known batch type emulsification method. A melting complex including a colorant and a resin together with an aqueous medium are emulsified in a tank being situated in an emulsifier by the method. By this batch-style method, macro mixture by liquid circulation in a tank is made to grapple with an emulsifier or micro dispersion by dispersion machine. However, there is a problem not to be able to secure enough productivity.

SUMMARY OF THE INVENTION

The present inventors recognized that a need exists for a method of stably and efficiently manufacturing a toner which has a uniform particle diameter with a sharp particle size distribution, the method preferably being able to use small facilities effectively.

Accordingly, an object of the present invention is to provide a method of stably and efficiently manufacturing toner which has excellent releasing property at low temperature, few occurrences of filming, and a good combination of a low temperature fixing property and a high temperature preserving property to obtain quality images.

Other objects of the invention include the toner itself and its methods of use.

Briefly these objects and other objects of the present invention as hereinafter described and as will become more readily apparent can be attained, either individually or in combination thereof, by a method of manufacturing a toner including dispersing at least one of a binder resin and/or a precursor thereof, a coloring agent and a releasing agent in an organic solvent to obtain an oil phase, dispersing the oil phase in an aqueous medium with a shearing force to obtain a dispersion emulsion, wherein the shearing force during emulsification is provided by a "countercurrent" system using two oppositely moving surfaces. In one exemplary embodiment the "countercurrent" system can be a screen that is situated around a rotor, wherein the screen spins round in an opposite direction from the direction that the rotor itself spins. In another embodiment the tank wall can rotate in a direction opposite to a stirrer. The invention is not limited to these embodiments.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
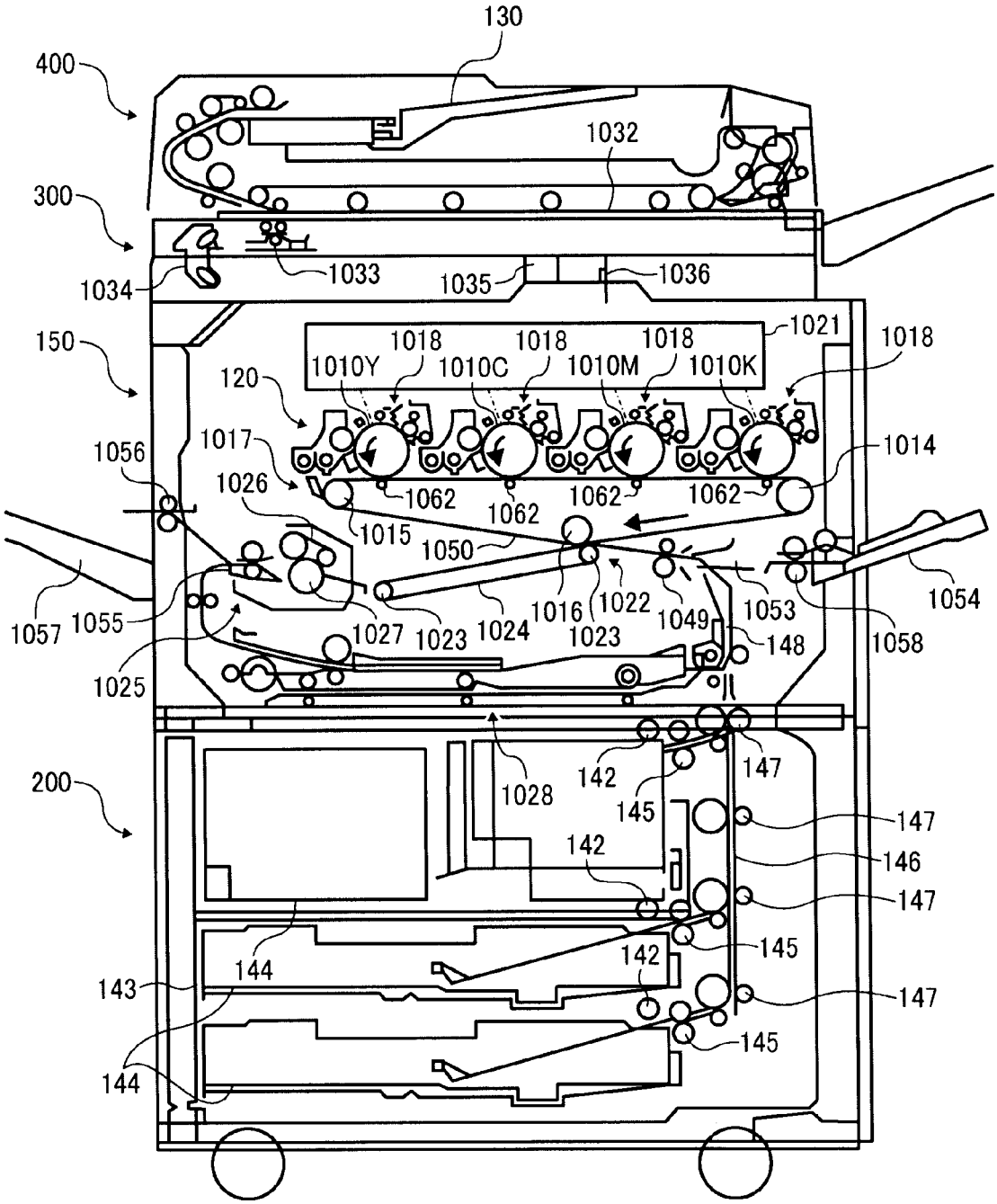
FIG. 1 is a diagram illustrating a cross section of an example of an image forming apparatus.

The present invention will be described below in detail with reference to several embodiments and accompanying drawings. The invention is not limited to these specific embodiments.

As an example of an emulsification, dispersion, mixing, etc., system useful in the present invention, that disclosed in JPO 4-114725 can be used. JPO 4-114725 is incorporated herein by reference in its entirely. An embodiment of a stirrer that can be used in the present invention is described in FIG. 3 to FIG. 6 herein. In FIG. 3 to FIG. 6, the stirrer includes a bath 1, a stirring chamber 2, a blade wheel 3, a body of basin 11, a pipe for supporting 17, a housing of upper part 21, a housing of bottom part 22, suction port 23, discharge port 25, wing 31, rotating shaft of upper part 41, motor of upper part 42, rotating shaft of bottom part 51 and motor of bottom part 52.

Figure 3:
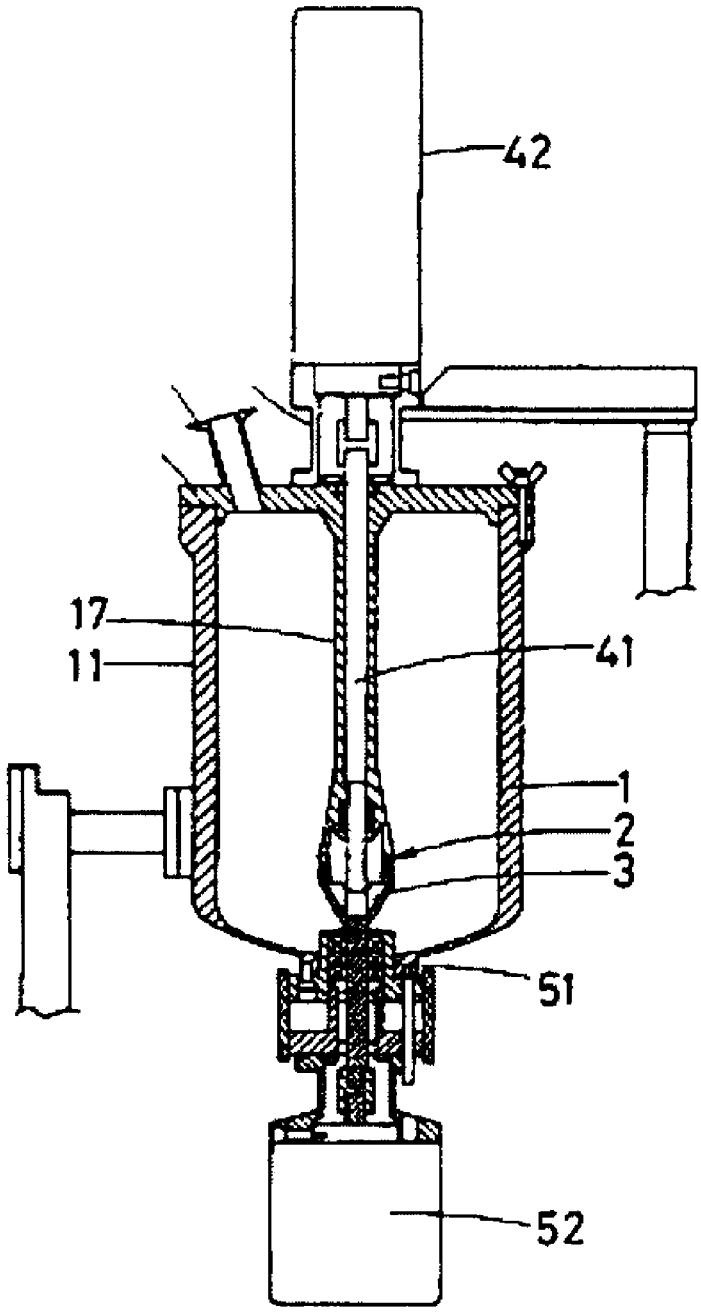
FIG. 3 is a sectional view of a stirrer.
Figure 4:
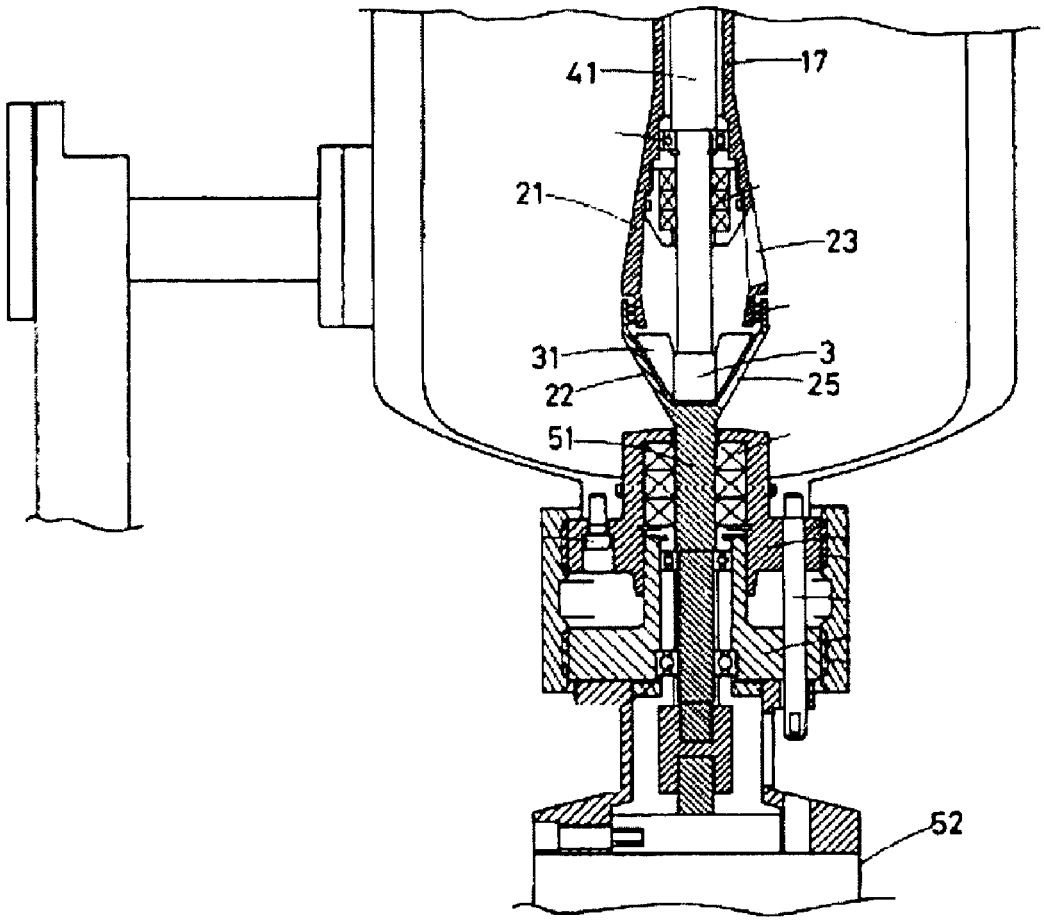
FIG. 4 is a enlarged view of a stirrer.
Figure 5:
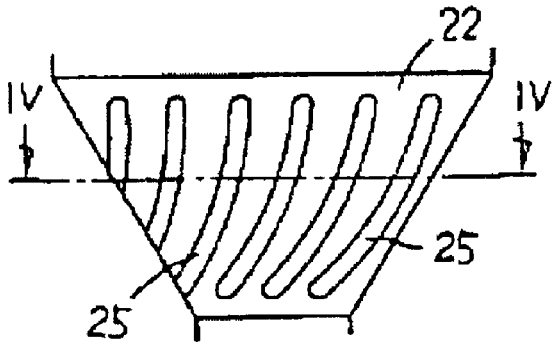
FIG. 5 is a enlarged view of a housing of a bottom part.
Figure 6:
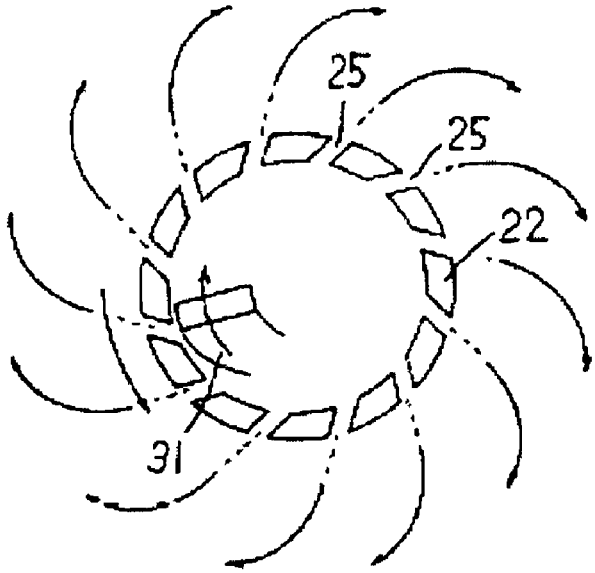
FIG. 6 is a sectional view in plane IV-IV of FIG. 5.

A stirring chamber 2 in FIG. 3 is arranged in a fluid to be subjected to treatment such as emulsification, dispersion or mixing and a blade wheel 3 is arranged in the stirring chamber 2. The blade wheel 3 is rotated to perform emulsification, dispersion or mixing in the gaps between the inner wall of the stirring chamber and the tips or rotary blades. A suction port 23 sucking the fluid from the outside to the inside and a discharge port 25 discharging the fluid from the inside to the outside are provided the stirring chamber 2. The inner wall of the place (housing of bottom part) 22 forming gaps along with the tips of blades (wing 31) in the stirring chamber is rotated in the direction reverse to the rotary direction of the blade wheel 3. As a result, in such a state the number of rotations of the blade wheel itself is increased to the max. limit, shearing force, energy quantity and passing number are enhanced, and treatment capacity is enhanced.

It is preferred that, in the method of manufacturing a toner according to the present invention, a circumferential speed in total of the rotor and the screen, etc. is from 30 (m/S) to 70 (m/S).

It is preferred that, in the method of manufacturing a toner, dispersing at least one of a binder resin (if used), a precursor comprises a modified polyester thereof (if used), a coloring agent, a releasing agent in an organic solvent to obtain an oil phase, dissolving a compound which elongates or cross-links with the precursor in the oil phase, also includes dispersing the oil phase in an aqueous medium includes a particulate dispersion agent to obtain a dispersion emulsion, conducting cross-linking reaction and elongation reaction of the precursor in the emulsified liquid dispersion and removing the organic solvent.

In another preferred embodiment, in the method mentioned above, the wax liquid dispersion includes part of the binder resin.

In another preferred embodiment, in the method mentioned above, a laminar inorganic mineral having ions between layers in which at least part of the ions are modified by an organic ion is dissolved or dispersed in the oil phase.

In another preferred embodiment, in the method mentioned above, the binder resin includes a polyester resin.

In another preferred embodiment, in the method mentioned above, the content of the polyester resin in the binder resin ranges from 50 to 100% by weight.

In another preferred embodiment, in the method mentioned above, the weight average molecular weight of portion of the polyester resin which is soluble in tetrahydrofuran (THF) ranges from 1,000 to 30,000.

In another preferred embodiment, in the method mentioned above, the polyester resin is a polyester resin having an acid group which has an acid value of from 1.0 to 50.0 (KOHmg/g).

In another preferred embodiment, in the method mentioned above, the polyester resin has a glass transition temperature of from 35 to 65° C.

In another preferred embodiment, in the method mentioned above, the precursor is a polymer having a portion reactive with a compound having an active hydrogen, the compound which elongates or cross-links with the precursor has an active hydrogen group and the polymer having a portion reactive with a compound having an active hydrogen has a weight average molecular weight of from 3,000 to 20,000.

In another preferred embodiment, in the method mentioned above, a laminar inorganic mineral having ions between layers in which at least part of the ions are modified by an organic ion is dissolved or dispersed in the oil phase.

In another preferred embodiment, in the method mentioned above, the toner has an acid value of from 0.5 to 40.0 (KOHmg/g).

In another preferred embodiment, in the method mentioned above, the toner has a glass transition temperature of from 40 to 70° C.

In another preferred embodiment, in the method mentioned above, the toner has a volume average particle diameter is from 3 to 7 μm In another preferred embodiment, in the method mentioned above, the toner has a ratio (Dv/Dn) of a volume average particle diameter (Dv) to a number average particle diameter (Dn) of 1.30 or lower.

In another preferred embodiment, in the method mentioned above, the toner particle having a particle diameter of 2 μm or smaller is not greater than 20% by number.

In another preferred embodiment, in the method mentioned above, the toner particle having a circularity of 0.93 to 0.97 on average.

Another illustrative embodiment provides a toner that is manufactured according to the method mentioned above. These and other objects, including the use of such toners, features and advantages of the present invention will become apparent upon consideration of the following description of the preferred embodiments of the present invention taken in conjunction with the accompanying drawings.

In the present invention, as the method of manufacturing the toner, dispersing at least one of a binder resin (and/or precursor thereof), a coloring agent and a releasing agent in an organic solvent to obtain an oil phase, dispersing the oil phase in an aqueous medium with a shearing force to obtain a dispersion emulsion, wherein the shearing force during a process for emulsification is provided by a "countercurrent" method made for example by a screen that is situated around the rotor, the screen spins round to an opposite direction from the direction that the rotor itself spins round with a high rotation.

As a preferred emulsification state, each particle in the emulsification liquid exists individually and stably without coalescing each other.

When the shearing force isn't strong enough or the time period for giving the shearing force isn't long enough during the emulsification process, it doesn't always provide an ideal mixing ratio of an oil phase and an aqueous phase on the spot in the shear teeth where the mixture begins to be received a shearing force. On the other hand, when a screen, container vessel, etc., that is situated around the rotor, spins round in an opposite direction from the direction that the rotor itself spins round with a high rotation speed, the mixed liquid of an oil phase and an aqueous phase is given a strong shearing force, and also by adapting the time period for giving the shearing force, emulsification liquid having a sharp particle diameter distribution is provided even when the number of emulsification passes is one.

As an emulsifier machine that has a rotor spinning round with a high rotation speed and a screen spinning round to a opposite direction from the direction that the rotor itself spins round, CLEARMIX W motion (manufactured by M Technique Co., Ltd. ) can be used.

When shearing force is too strong, an emulsification particle can be destroyed, and it becomes difficult to maintain the state as a fine particle during the process of fine particles being provided, large particles are provided by coalescing of each particle and particle diameter distribution tends to be broad. The circumferential speed in total of the rotor and the screen, vessel, etc. is preferably not lower than 30 (m/s) and not higher than 70 (m/s).

In the present invention, the oil phase containing toner components is preferably dissolved or dispersed in an organic solvent. As the toner components, a binder resin and/or precursor thereof, a colorant and a releasing agent are included. The solvent preferably contains the organic solvent. The organic solvent is preferably removed when or after mother toner particles are formed.

The organic solvent can be suitably selected and it is preferably an organic solvent having a boiling point lower than 150° C. since it is easy to remove such an organic solvent. Specific examples thereof include, but are not limited to, organic solvents, organic solvents insoluble in water such as toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate and ethyl acetate and organic solvents soluble in water such as methylethyl ketone and methylisobutyl ketone. Among these, toluene, xylene, benzene, methylene chloride, 1,2-dichloroethane, chloroform, and carbon tetrachloride are preferred and ethyl acetate is particularly preferred. These can be used alone or in combination.

The content of the organic solvent (A) can be suitably determined and preferably from 40 to 300 parts by weight, more preferably from 60 to 140 parts by weight and particularly preferably from 80 to 120 parts by weight.

The oil phase can contain a binder resin and/or a precursor thereof (preferably a precursor of binder resin, if present, comprises a modified polyester. Also, if a precursor is present a cross-linking agent and/or an elongation agent reactive with the precursor is also preferably present), a releasing agent, a coloring agent, and a laminar inorganic mineral having ions between layers in which at least part of the ions are modified by an organic ion. Other materials can be optionally selected. As the binder resin component, the toner component preferably contains a polyester.

Laminar Inorganic Mineral

The modified laminar inorganic mineral having ions between layers in which at least part of the ions are modified by an organic ion is preferably a laminar inorganic mineral having a basic crystal structure of smectite which is modified by an organic cation. In addition, part of the divalent metal in the laminar inorganic mineral can be substituted by a trivalent metal to introduce a metal anion. However, since a laminar inorganic mineral to which a metal anion is introduced is hydrophilic, a laminar inorganic mineral having a metal anion part of which is modified by an organic anion.

Specific examples of organic ion modification agents for modifying the laminate inorganic mineral having ions in which at least part of the ions are modified by an organic ion include, but are not limited to, quaternary alkyl ammonium salts, phosphonium salts and imidazolium salts. Among these, quaternary alkyl ammonium salts are preferred. Specific examples of the quaternary alkyl ammonium salts include trimethyl stearyl ammonium, dimethyl stearyl benzyl ammonium, diemthyl octadecyl ammonium, and oleylbis(2-hydroxyethyl)methylammonium.

Specific examples of the organic ion modification agents include, but are not limited to, a sulfate salt, a sulfonate, a craboxylate, or a phosphate having a branched, non-branched or cyclic alkyl group (C1 to C44), an alkenyl group (C1 to C22), an alkoxy group (C8 to C32), a hydroxyalkyl (C2 to C22), ethylene oxide, propylene oxide, etc. Among these, a carboxylate having an ethylene oxide skeleton is preferred.

By at least partially modifying a laminar inorganic mineral with an organic ion, the laminar inorganic mineral can have a moderate hydrophobic property. Thus, the oil phase containing a toner component and/or a precursor thereof can have a non-Newtonian viscosity and the toner particles can have an irregular form.

The content of a laminar inorganic mineral at least partially modified by an organic ion is preferably from 0.05 to 2% by weight based on the toner material.

Specific examples of the laminar inorganic mineral at least some of which is modified by an organic ion include, but are not limited to, montmorillonite, bentonite, hectorite, attapulgite, sepiolite and mixtures thereof. Among these, montmorillonite and bentonite are preferred since these do not affect toner characteristics, it is easy to adjust the viscosity, and the addition amount thereof can be small.

Specific examples of the market products of the laminar inorganic minerals at least part of which is modified by organic ions include, but are not limited to, BENTONE 3, BENTONE 38, BENTONE 38V (manufactured by Elementis Specialties, Inc.), TIXOGEL VP (manufactured by United Catalyst Corporation), CLAYTONE 34, CLAYTONE 40, and CLAYTONE XL (manufactured by Southern Clay Inc.); Stearal conium BENTONITE, e.g., BENTONITE 27 (manufactured by Elementis Specialties, Inc.), TIXOGEL LG (manufactured by United Catalyst Corporation), and CLAYTONE AF and CLAYTONE APA (manufactured by Southern Clay Inc.) ; and QUATANIUM 18/BENZACONIUM BENZONITE. Among these, CLAYTONE AF and CLAYTONE APA are particularly preferred. As the laminar inorganic mineral at least some of which is modified by an organic anion, a laminar inorganic mineral obtained by modifying DHT-4A (manufactured by Kyowa Chemical Industry Co., Ltd.) with the organic anion represented by the following chemical formula is particularly preferred.

$$R_1(OR_2)_nOSO_3M$$

In the chemical formula, $R_1$ represents an alkyl group having 13 carbon atoms, $R_2$ represents an alkine group having 2 to 6 carbon atoms. N represents an integer of from 2 to 10, and M denotes a monovalent metal element.

An example represented by the chemical formula is HITENOL® 330T (manufactured by Dai-ichi Kogyo Seiyaku Co., Ltd.).

Since such a modified laminar inorganic mineral has a moderate hydrophobic property, the modified laminar inorganic mineral tends to be present on the interface of droplets, i.e., locally present on the surface of toner, which leads to good demonstration of chargeability.

The toner for use in the present invention is preferably obtained by dissolving or dispersing a toner composition including at least a binder resin, a colorant and a releasing agent in the organic solvent to obtain a solution or liquid dispersion as an oil phase, mixing the oil phase with an aqueous medium, emulsifying the mixed liquid as an emulsifying process. The oil phase preferably contains a precursor of a binder resin that comprises a modified polyester and a cross-linking agent and/or an elongation agent reactive with the precursor. After reacting the oil phase with a cross-linking agent and/or an elongation agent in an aqueous medium including a dispersion agent, the solvent from the resultant liquid dispersion is preferably removed.

A specific example of the precursor of binder resins that comprise a modified polyester for use in the present invention is a polyester prepolymer (A) having an isocyanate group. A specific example of the polyester prepolymer (A) is a compound obtained by conducting reaction between a polyisocyanate (PIC) and a polyester having an active hydrogen group which is a polycondensation of the polyol (PO) and the polycarbobate (PC). Specific examples of the active hydrogen group contained in the polyester include, but are not limited to, hydroxyl groups (alcohol hydroxyl groups and phenol hydroxyl groups), amino groups, carboxylic groups, and mercarpto groups. Among these, alcohol hydroxyl groups are preferred.

Amines are used as a cross-linking agent to the reactive modified polyester based resins and diisocyanate compounds (diphenylmethane diisocyanate, etc.) are used as an elongation agent. Amines, which are described in detail later, function as a cross-linking agent and/or an elongation agent for modified polyesters reactive with active hydrogen.

Modified polyesters such as urea modified polyesters obtained by reaction between the polyester prepolymer (A) having an isocyanate group and the amine (B) can be easily controlled about the molecular weight of the polymer component of the modified polyester. This is advantageous to secure the low temperature fixing property for dry toner, especially in a case in which an oil application mechanism for a heating medium is not used. A polyester prepolymer urea-modified at its end especially prevents adhesion of toner to a heating medium for fixing while not damaging the high fluidity and transparency of a non-modified polyester resin in the fixing temperature range.

Polyester prepolymers preferably for use in the present invention are obtained by introducing a functional group such as an isocyanate group reactive with an active hydrogen to a polyester having an active hydrogen group such as an acid group or a hydroxyl group at its end. Modified polyesters (MPE) such as a urea-modified polyester can be produced from this polyester prepolymer. In the present invention, the urea-modified polyesters preferably used as the toner binder are obtained by conducting reaction of the polyester prepolymer (A) having an isocyanate group with the amine (B) functioning as a cross-linking agent and/or an elongation agent. The polyester prepolymer (A) having an isocyanate group can be obtained by reacting a polyisocyanate (PIC) with a polyester having an active hydrogen group which is a polycondensation of the polyol (PO) and the polycarbobate (PC). Specific examples of the active hydrogen group contained in the polyesters mentioned above include, but are not limited to, hydroxyl groups (alcohol hydroxyl groups and phenol hydroxyl groups), amino groups, carboxylic groups, and mercarpto groups. Among these, alcohol hydroxyl groups are preferred.

Suitable polyols (PO) include diols (DIO) and polyols (TO) having three or more hydroxyl groups. It is preferred to use a diol (DIO) alone or mixtures in which a small amount of a polyol (TO) is mixed with a diol (DIO). Specific examples of the diols (DIO) include, but are not limited to, alkylene glycol (e.g., ethylene glycol, 1,2-propylene glycol, 1,3-propylene glycol, 1,4-butanediol and 1,6-hexanediol); alkylene ether glycols (e.g., diethylene glycol, triethylene glycol, dipropylene glycol, polyethylene glycol, polypropylene glycol and polytetramethylene ether glycol); alicyclic diols (e.g., 1,4-cyclohexane dimethanol and hydrogenated bisphenol A); bisphenols (e.g., bisphenol A, bisphenol F and bisphenol S); adducts of the alicyclic diols mentioned above with an alkylene oxide (e.g., ethylene oxide, propylene oxide and butylene oxide); and adducts of the bisphenols mentioned above with an alkylene oxide (e.g., ethylene oxide, propylene oxide and butylene oxide); etc. Among these compounds, alkylene glycols having from 2 to 12 carbon atoms and adducts of a bisphenol with an alkylene oxide are preferable. More preferably, adducts of a bisphenol with an alkylene oxide, or mixtures of an adduct of a bisphenol with an alkylene oxide and an alkylene glycol having from 2 to 12 carbon atoms are used. Specific examples of the polyols (TO) include, but are not limited to, aliphatic alcohols having three or more hydroxyl groups (e.g., glycerin, trimethylol ethane, trimethylol propane, pentaerythritol and sorbitol); polyphenols having three or more hydroxyl groups (trisphenol PA, phenol novolak and cresol novolak); adducts of the polyphenols mentioned above with an alkylene oxide; etc.

Suitable polycarboxylic acids (PC) include dicarboxylic acids (DIC) and polycarboxylic acids (TC) having three or more carboxyl groups. It is preferred to use dicarboxylic acids (DIC) alone or mixtures in which a small amount of a polycarboxylic acid (TC) is mixed with a dicarboxylic acid (DIC).

Specific examples of the dicarboxylic acids (DIC) include, but are not limited to, alkylene dicarboxylic acids (e.g., succinic acid, adipic acid and sebacic acid); alkenylene dicarboxylic acids (e.g., maleic acid and fumaric acid); aromatic dicarboxylic acids (e.g., phthalic acid, isophthalic acid, terephthalic acid and naphthalene dicarboxylic acids; etc. Among these compounds, alkenylene dicarboxylic acids having from 4 to 20 carbon atoms and aromatic dicarboxylic acids having from 8 to 20 carbon atoms are preferably used.

Specific examples of the polycarboxylic acids (TC) having three or more hydroxyl groups include, but are not limited to, aromatic polycarboxylic acids having from 9 to 20 carbon atoms (e.g., trimellitic acid and pyromellitic acid).

As the polycarboxylic acid (TC), anhydrides or lower alkyl esters (e.g., methyl esters, ethyl esters or isopropyl esters) of the polycarboxylic acids specified above can be used for the reaction with a polyol.

Suitable mixing ratio (i.e., an equivalence ratio [OH]/[COOH]) of a polyol (PO) to a polycarboxylic acid (PC) is from 2/1 to 1/1, preferably from 1.5/1 to 1/1 and more preferably from 1.3/1 to 1.02/1.

Specific examples of the polyisocyanates (PIC) include, but are not limited to, aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic didicosycantes (e.g., tolylene diisocyanate and diphenylmethane diisocyanate); aromatic aliphatic diisocyanates (e.g., α, α, α', α'-tetramethyl xylylene diisocyanate); isocyanurates; blocked polyisocyanates in which the polyisocyanates mentioned above are blocked with phenol derivatives, oximes or caprolactams; etc. These compounds can be used alone or in combination.

When a polyester prepolymer (A) having an isocyanate group is obtained, a suitable mixing ratio (i.e., [NCO]/[OH]) of a polyisocyanate (PIC) to a polyester having a hydroxyl group is from 5/1 to 1/1, preferably from 4/1 to 1.2/1 and more preferably from 2.5/1 to 1.5/1. When the [NCO]/[OH] ratio is too large, the low temperature fixability of the toner easily deteriorates. When the [NCO]/[OH] ratio is too small, the content of the urea in the ester decreases when a modified polyester is used, which leads to deterioration of hot offset resistance. The content of the constitutional component of a polyisocyanate (PIC) in the polyester prepolymer (A) having a polyisocyanate group at its end portion is from 0.5 to 40% by weight, preferably from 1 to 30% by weight and more preferably from 2 to 20% by weight.

The number of isocyanate groups included in the prepolymer (A) per molecule is normally not less than 1, preferably from 1.5 to 3, and more preferably from 1.8 to 2.5. When the number of isocyanate groups is too small, the molecular weight of the urea-modified polyester tends to be small, which degrades the hot offset resistance.

Specific examples of the amine (B) include, but are not limited to, diamines (B1), polyamines (B2) having three or more amino groups, amino alcohols (B3), amino mercaptans (B4), amino acids (B5), and blocked amines (B6), in which the amines (B1-B5) mentioned above are blocked.

Specific examples of the diamines (B1) include, but are not limited to, aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophoron diamine); aliphatic diamines (e.g., ethylene diamine, tetramethylene diamine and hexamethylene diamine); etc.

Specific examples of the polyamines (B2) having three or more amino groups include, but are not limited to, diethylene triamine, triethylene and tetramine. Specific examples of the amino alcohols (B3) include, but are not limited to, ethanol amine and hydroxyethyl aniline. Specific examples of the amino mercaptan (B4) include, but are not limited to, aminoethyl mercaptan and aminopropyl mercaptan. Specific examples of the amino acids (B5) include, but are not limited to, amino propionic acid and amino caproic acid. Specific examples of the blocked amines (B6) include, but are not limited to, ketimine compounds which are prepared by reacting one of the amines B1-B5 mentioned above with a ketone such as acetone, methyl ethyl ketone and methyl isobutyl ketone; oxazoline compounds, etc. Among these compounds, diamines (B1) and mixtures in which a diamine (B1) is mixed with a small amount of a polyamine (B2) are preferable.

Furthermore, the molecular weight of the polyesters can be controlled when a prepolymer (A) and an amine (B) are reacted, if desired. Specific examples of such molecular weight control agents include, but are not limited to, monoamines (e.g., diethyl amine, dibutyl amine, butyl amine and lauryl amine) having no active hydrogen group, and blocked amines (i.e., ketimine compounds) prepared by blocking the monoamines specified above.

The mixing ratio of the amines (B) to the prepolymer (A), i.e., the equivalent ratio ([NCO]/[NHx]) of the isocyanate group [NCO] contained in the prepolymer (A) to the amino group [NHx] contained in the amines (B), is normally from 1/2 to 2/1, preferably from 1.5/1 to 1/1.5 and more preferably from 1.2/1 to 1/1.2.

The mixing ratio of the amines (B) to the prepolymer (A), i.e., the equivalent ratio ([NCO]/[NHx]) of the isocyanate group [NCO] contained in the prepolymer (A) to the amino group [NHx] contained in the amines (B), is normally from 1/2 to 2/1, preferably from 1.5/1 to 1/1.5 and more preferably from 1.2/1 to 1/1.2.

In the present invention, the polyester based resins (polyester) preferably used as the binder resin are urea-modified polyesters (UMPE). These urea-modified polyesters (UMPE) can include a urethane linkage as well as a urea linkage. The molar ratio of the content of the urea linkage to the content of the urethane linkage may vary from 100/0 to 10/90, preferably from 80/20 to 20/80 and more preferably from 60/40 to 30/70.

The urea-modified polyesters (UMPE) of the present invention can be prepared in different ways, including, for example, one-shot methods. The weight average molecular weight of the urea-modified polyesters (UMPE) is not less than 10,000, preferably from 20,000 to 10,000,000 and more preferably from 30,000 to 1,000,000. However, when a urea-modified polyester (UMPE) is used alone, the number average molecular weight thereof ranges from 2,000 to 20,000, preferably from 2,000 to 10,000 and more preferably from 2,000 to 8,000.

In the present invention, the modified polyester such as the urea-modified polyester (UMPE) can be used in combination with an unmodified polyester (PE) contained as the binder resin component. By using a combination of a urea-modified polyester (UMPE) with an unmodified polyester (PE), the low temperature fixability of the toner improves and in addition the toner can produce color images having high gloss when the toner is used in a full-color image forming apparatus. The combinational use is preferred to a single use of the modified polyester. Specific examples of the polyester (PE) include, but are not limited to, polycondensation products of the polyol (PO) and the polycalboxylic acid (PC) specified for the polyester component of the urea-modified polyester (UMPE) and preferred examples thereof are the same as those for the urea-modified polyester (UMPE). The weight average molecular weight (Mw) of the polyester (PE) ranges from 10,000 to 300,000 and preferably from 14,000 to 200,000. The number average molecular weight (Mn) of the polyester (PE) preferably ranges from 1,000 to 10,000 and preferably from 1,500 to 6,000. In addition to the non-modified polyester, modified polyesters modified by a chemical linkage other than urea linkage, for example, urethane linkage, can be used in combination with the urea-modified polyester (UMPE).

The urea-modified polyester (UMPE) and the non-modified polyester (PE) are preferred to be at least partially compatible with each other to improve the low temperature fixability and hot offset resistance properties. Therefore, it is preferable, but not mandatory, that the polyester component in the urea-modified polyester (UMPE) has a similar composition to that of the non-modified polyester (PE). The weight ratio of the urea-modified polyester/the non-modified polyester is normally from 5/95 to 80/20, preferably from 5/95 to 30/70, more preferably from 5/95 to 25/75 and even more preferably from 7/93 to 20/80. A content of the urea-modified polyester (UMPE) that is too small can degrade the hot offset resistance of the toner and in addition be disadvantageous in terms of a good combination of the high temperature preservability and low temperature fixability.

According to a further study about the present invention, it is preferred to use a polyester resin having an acid group (the polyester resin having an acid value of from 1.0 to 50.0) as a binder resin to maintain a high temperature preservability, effectively demonstrate a low temperature fixing property and impart anti-offset property after modification by a prepolymer, and the weight average molecular weight of the portion of the polyester resin having an acid group which is soluble in THF is preferably from 1,000 to 30,000.

The molecular weight can be measured by gel permeation chromatography (GPC) as follows: Stabilize a column in a heat chamber at 40° C.; Flow tetrahydrofuran (THF) at this temperature at 1 ml/min as a column solvent; Fill 50 to 200 μl of a tetrahydrofuran sample solution of a resin which is prepared to have a sample density of 0.05 to 0.6 weight % for measurement. The molecular weight distribution of the sample is calculated by comparing the logarithm values and the count values of the analytical curves obtained from several kinds of single dispersion polystyrene standard sample. Specific examples of the standard polystyrene samples for the analytical curves include polystyrenes having a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$ and $4.48\times10^6$, manufactured by Pressure Chemical Co., or Tosoh Corporation. It is preferred to use at least about ten standard polystyrene samples. A refractive index (RI) detector can be used as the detector.

The hydroxyl value (KOHmg/g) of the polyester (PE) is preferably 5 or higher.

When the acid value (KOHmg/g) of the polyester resin having an acid group is from 1.0 to 50.0 (KOHmg/g), the produced toner is easily controlled its particle diameter according to adding a base compound and efficient properties of toner is provides. As the efficient properties, a low temperature fixing property, a high temperature preservability, a hot offset resistance, a stability of chargeability are included. When the acid value is larger than 50.0 (KOHmg/g), elongation or cross-linking reaction of the modified polyester can be insufficient, which affects the hot offset resistance property. When the acid value is smaller than 1.0 (KOHmg/g), the dispersion stability effect by the base compound during manufacturing may not easily be obtained so that the elongation or cross-linking reaction of the modified polyester tends to proceed excessively, which causes a problem in manufacturing stability.

Measuring Method of Hydroxyl Value

Precisely weigh 0.5 g of a sample in a 100 ml flask; correctly add 5 ml to acetylation reagent thereto; heat the system by placing in a bath in the temperature range of from 95 to 105° C.; after one to two hours, remove the flask from the bath; subsequent to cooling down and addition of water, decompose acetic anhydride by shaking the flask; heat the flask in the bath again for at least 10 minutes to complete the decomposition; subsequent to cooling down, steadily wash the wall of the flask with an organic solvent; conduct potentiometric titration of the liquid using a solution of N/2 potassium hydroxide ethyl alcohol with the electrode specified above to obtain the hydroxyl value (according to JIS K0070-1966).

The acid value of the polyester resin for use in the present invention is measured according to JIS K0070. When a sample is not dissolved, a solvent such as dioxane or THF is used.

The acid value can be determined according to the following procedure:

Measuring device: automatic potentiometric titrator (DL-53 Titrator manufactured by Mettler Toledo International Inc.)

Electrode: DG113-SC (manufactured by Mettler Toledo International Inc.)

Analysis software: LabX Light Version 1.00.000

Calibration: use a solvent mixture of 120 ml of toluene and 30 ml of ethanol

Measuring temperature: 23° C.

The measuring conditions are as follows.

| Stir | |
|---|---|
| Speed [%] | 25 |
| Time [s] | 15 |
| EQP titration | |
| Titrant/Sensor | |
| Titrant | CH3ONa |
| Concentration [mol/L] | 0.1 |
| Sensor | DG115 |
| Unit of measurement | mV |
| Predispensing to volume | |
| Volume [mL] | 1.0 |
| Wait time [s] | 0 |
| Titrant addition | Dynamic |
| dE(set) [mV] | 8.0 |
| dV(min) [mL] | 0.03 |
| dV(max) [mL] | 0.5 |
| Measure mode | Equilibrium controlled |
| dE [mV] | 0.5 |
| dt [s] | 1.0 |
| t(min) [s] | 2.0 |
| t(max) [s] | 20.0 |
| Recognition | |
| Threshold | 100.0 |
| Steepest jump only | No |

-continued

| | |
|---|---|
| Range | No |
| Tendency | None |
| Termination | |
| at maximum volume [mL] | 10.0 |
| at potential | No |
| at slope | No |
| after number EQPs | Yes |
| n = 1 | |
| comb. termination conditions | No |
| Evaluation | |
| Procedure | Standard |
| Potential 1 | No |
| Potential 2 | No |
| Stop for reevaluation | No |

Method of Measuring Acid Value

The acid value can be measured according to the measuring method described in JIS K0070-1992.

Sample adjustment: 0.5 g of polyester (the composition soluble in ethyl acetate: 0.3 g ) is added to 120 ml of toluene and the mixture is stirred at room temperature (23° C.) for about 10 hours to dissolve the polyester. 30 ml of ethanol is added thereto to prepare a sample solution.

The acid value can be measured by the device described in JIS K0070-1992 and calculated specifically as follows:

Preliminarily standardized N/10 caustic potash—alcohol solution is used for titration and the acid is calculated from the consumed amount of the caustic potash—alcohol solution based on the following relationship:

Acid value=KOH (ml)×N×56.1/(weight of sample material), where N represents the factor in N/10 KOH In the present invention, the glass transition temperature (Tg) of the toner is in the range of from 40 to 70° C., preferably from 40 to 60° C. When the glass transition temperature is lower than 40° C., heat-resisting property tends to be insufficient. A glass transition temperature is higher than 70° C. tends to have an adverse impact on the low temperature fixing property. Since an unmodified polyester such as a urea-modified polyester coexists in the binder resin, the glass transition temperature of the toner has a good high temperature preservability even when the glass transition temperature is relatively low in comparison with that of a known polyester based toner.

In the present invention, the high temperature preservability of the modified polyester resin, i.e., the main component of a binder resin, depends on the glass transition temperature of the polyester resin before modification. The glass transition temperature of the polyester resin before modification is preferably designed to be in the range of from 35 to 65° C. That is, when the glass transition temperature is lower than 35° C., the anti-high temperature preservability tends to be insufficient. A glass transition temperature that is higher than 65° C. tends to have an adverse impact on the low temperature fixing property.

In the present invention, the glass transition temperature can be measured by the following method in which, for example, TG-DSC system TAS-100 (manufactured by Rigaku Corporation) is used: Place about 10 mg of a toner sample in a sample container made of aluminum; Place the sample container on a holder unit; Set the holder unit in an electric furnace; Heat the electric furnace from room temperature to 150° C. at a temperature rising speed of 10° C./min; Leave it at 150° C. for 10 minutes; Cool down the sample to room temperature and leave it for 10 minutes; Thereafter, heat the sample in a nitrogen atmosphere to 150° C. at a temperature descending speed of 10° C./min; Measure the DSC curve by a differential scanning calorimeter (DSC); and, from the obtained DSC curve, calculate the glass transition temperature (Tg) from the intersection point of a tangent of the endothermic curve around the glass transition temperature (Tg) and the base line using the analysis system installed in TAS-100 system.

According to a further study of the present invention, a prepolymer modifying the polyester resin is a binder resin component to have a good low temperature fixing property and a hot offset resistance property and the weight average molecular weight of the polymer is preferably from 3,000 to 20,000. That is, when the weight average molecular weight is too small, the reaction speed control tends to be difficult, which causes a problem of the manufacturing stability. When a weight average molecular weight is too large, the modified polyester tends to be insufficiently obtained, which has an impact on the offset resistance.

According to a further study on the present invention, it is found that the acid value of a toner has a large impact on the low temperature fixing property and the hot offset resistance in comparison with the acid value of a binder resin. The acid value of the toner of the present invention relates to the end carboxyl group of a non-modified polyester and the acid value of the non-modified polyester is preferably from 0.5 to 40.0 KOHmg/g to control the low temperature fixing property (e.g., lowest fixing temperature and hot offset occurrence temperature) of the toner. When the acid value of the toner is excessively large, elongation or cross-linking reaction of the modified polyester tends to be insufficient, which affects the hot offset resistance property. When the toner acid value is excessively small, the dispersion stability effect by the base compound during manufacturing is not easily obtained so that the elongation or cross-linking reaction of the modified polyester tends to proceed excessively, which causes a problem in manufacturing stability.

The acid value of the toner is measured according to JIS K0070. When a sample is not dissolved in a solvent, another solvent such as dioxane or THF is used.

The glass transition temperature of the toner of the present invention preferably ranges from 40 to 70° C. to obtain a good low temperature fixing property, a good high temperature preservability, and a high durability. When the glass transition temperature is too low, blocking in a development device and filming on an image bearing member tend to occur. When the glass transition temperature is too high, the low temperature fixing property easily deteriorates.

Wax

In the present invention, the content of wax (releasing agent) is preferably in an amount of from 1 to 10% based on toner. When the content is too small, the target releasing property is not obtained, which leads to deterioration of the fixing property. A content that is too large tends to cause a filming problem. As a wax (releasing agent) for use in the toner for use in the present invention, a wax having a low melting point (from 50 to 120° C.) effectively functions in the dispersion with a binder resin at the interface between a fixing roller and a toner. Thereby, the toner has a good hot offset resistance without applying a releasing agent such as oil to a fixing roller. The melting point of the wax for use in the present invention is the maximum endothermic peak according to the differential scanning calorimeter (DSC). The following material can be used as the wax component functioning as the releasing agent for use in the present invention.

Specific examples of such waxes include, but are not limited to, natural waxes such as plant waxes such as carnauba wax, cotton wax, haze wax, and rice wax, animal waxes such as yellow bees wax and lanoline, mineral waxes such as ozokerite and petroleum waxes such as paraffin wax, microcrystalline wax and petrolatum. Other than these natural waxes, synthetic hydrocarbon waxes such as Fisher-Tropsch wax and polyethylene wax, and synthetic waxes such as esters, ketons, and ethers can be used. Further, fatty acid amides such as 1,2-hydroxystearic acid amide, stearic acid amides, anhydrous phthalic acid imides and chlorinated hydrocarbons, homo polymers or copolymers (e.g., copolymers of n-staryl acrylate-ethylmethacrylate) of a polyacrylate, which is a crystalline polymer resin having a relatively low molecular weight, such as poly-n-stearyl methacrylate and poly-n-lauric methacrylate, and crystalline polymers having a long chain alkyl group on its branched chain can be also used. Among these, paraffin wax, polyethylene wax, polypropylene wax and Sazol wax are preferred and paraffin wax is particularly preferred.

Coloring Agent

There is no specific limit to the coloring agents for use in the toner. Specific examples thereof include, but are not limited to, carbon black, Nigrosine dyes, black iron oxide, Naphthol Yellow S, HANSA Yellow (10G, 5G and G), Cadmium Yellow, yellow iron oxide, loess, chrome yellow, Titan Yellow, polyazo yellow, Oil Yellow, HANSA Yellow (CR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, LITHOL Fast Scarlet G, Brilliant Fast Scarlet, Brilliant Carmine BS, Permanent Red (F2R, F4R, FRL, FRLL and F4RH), Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, PYRAZOLONE Red, polyazo red, Chrome Vermilion, Benzidine Orange, perynone orange, Oil Orange, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and a mixture thereof. The content of such a coloring agent is from 1 to 15% by weight and preferably from 3 to 10% by weight based on the content of toner.

Master batch pigments, which are prepared by combining a coloring agent with a binder resin, can be used as the coloring agent of the toner composition of the present invention.

Specific examples of the binder resins for use in the master batch pigments or for use in combination with master batch pigments include, but are not limited to, the modified polyester resins and the unmodified polyester resins mentioned above; styrene polymers and substituted styrene polymers such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins can be used alone or in combination.

The master batch mentioned above is typically prepared by mixing and kneading a resin and a coloring agent upon application of high shear stress thereto. In this case, an organic solvent can be used to boost the interaction of the coloring agent with the resin. In addition, flushing methods in which an aqueous paste including a coloring agent is mixed with a resin solution of an organic solvent to transfer the coloring agent to the resin solution and then the aqueous liquid and organic solvent are removed can be preferably used because the resultant wet cake of the coloring agent can be used as it is, i.e., dispensing with drying. In this case, a high shear dispersion device such as a three-roll mill is preferably used for mixing and kneading the mixture.

A method of manufacturing toner is known in which particles containing a coloring agent and a resin and particles formed of at least a charge control agent are mixed by a rotor in a container to attach and fix a charge control agent to the surface of toner particles. In the present invention, target toner particles are obtained in this method including a mixing process in which the particles are mixed in the container without having a fixing member extruding from the inner wall of the container at a circumferential speed of the rotor ranging from 40 to 150 m/sec.

The toner is described next.

The toner of the present invention optionally includes a charge control agent. Any known charge controlling agent can be used. Specific examples thereof include, but are not limited to, nigrosine dyes, triphenylmethane dyes, chrome containing metal complex dyes, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, metal salts of salicylic acid derivatives, etc. Specific examples thereof include, but are not limited to, BONTRON 03 (nigrosine dye), BONTRON P-51 (quaternary ammonium salt), BONTRON S-34 (metal containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE PR (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group, for example, sulfonic acid group, carboxyl group, quaternary ammonium group, etc.

The content of the charge control agent is determined depending on the kind of the binder resin used, whether or not an additive is added, and the toner manufacturing method including the dispersion method. Therefore, it is not easy to jump to any conclusion but the content of the charge control agent is preferably from 0.1 to 10 parts by weight, and more preferably from 0.2 to 5 parts by weight based on 100 parts by weight of the binder resin included in the toner. When the content is too large, the toner tends to have too large chargeability, which leads to reduction in the effect of a main charge control agent, and thereby the electrostatic force with a developing roller increases, resulting in deterioration of the fluidity of the toner and a decrease in the image density of toner images. These charge control agents and releasing agents can be melted, mixed and kneaded with a master batch and a binder resin or added when dissolved or dispersed in an organic solvent.

An external additive can be added to the toner of the present invention to help improving the fluidity, developability, chargeability of coloring agents. Inorganic particulates are suitably used as such an external additive. It is preferred for the inorganic particulate to have a primary particle diameter of from 5 nm to 2 μm, and more preferably from 5 nm to 500 nm. In addition, it is preferred that the specific surface area of such inorganic particulates measured by the BET method is from 20 to 500 $m^2/g$. The content of such an inorganic particulate is preferably from 0.01 to 5% by weight and particularly preferably from 0.01 to 2.0% by weight based on the weight of a toner.

Specific examples of such inorganic particulates include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc.

As a fluidity agent, it is preferred to use hydrophobic silica particulates and hydrophobic titanium oxide particulates in combination. Especially when stirring and mixing are performed using such particulates having an average particle diameter of not greater than 50 nm, the electrostatic force and van der Waals force with a toner are extremely ameliorated. Therefore, during stirring and mixing in the development device performed for obtaining a desired level of charging, a fluidity agent is not detached from a toner particle so that quality images can be obtained and the amount of toner remaining on an image bearing member after transfer is reduced.

Titanium oxide particulates are excellent in terms of environmental stability and image density stability but has a problem with charge rising characteristics. Therefore, when the addition amount of titanium oxide particulates is greater than the addition amount of silica particulates, the side effect of containing titanium oxide particulates may have a large impact. However, when the addition amount of hydrophobic silica particulates and hydrophobic titanium oxide particulates ranges from 0.3 to 1.5% by weight, desirable charge rise characteristics are obtained, i.e., the charge rise characteristics do not greatly deteriorate. That is, when photocopying is repeated, the quality of obtained images is stable and scattering of toner particles from the development device can be effectively prevented.

The binder resin for toner can be manufactured by the following methods, etc. Polyol (PO) and Polycarboxylic acid (PC) are heated under the presence of a known esterification catalyst such as tetrabuthoxy titanate and dibutyltin oxide to a temperature of from 150 to 280° C. with a reduced pressure, if desired, while removing produced water to obtain a polyester having a hydroxyl group. Then, polyisocyanate (PIC) is reacted with the polyester in the temperature range of from 40 to 140° C. to obtain polyester prepolymer (A) having an isocyanate group. The polyester prepolymer (A) is reacted with amine (B) at the temperature range of from 0 to 140° C. to obtain a urea-modified polyester (UMPE). The modified polyester has a number average molecular weight of from 1,000 to 10,000 and preferably from 1,500 to 6,000. When the polyisocyanate (PIC) is reacted or the polyester prepolymer (A) and the amine (B) are reacted, a solvent can be used, if desired. Specific examples thereof include, but are not limited to, aromatic solvents (e.g., toluene and xylene), ketones (e.g., acetone, methylethylketone and methylisobutyl ketone), esters (e.g., ethyl acetate), amides (e.g., dimethylformamide and dimethylacetamide), and ethers (e.g., tetrahydrofuran), which are inactive with a polyisocyanate (PIC). When polyester (PE) not modified with a urea-linkage is used in combination, this polyester (PE) is prepared by the same method as the method for a polyester having a hydroxyl group and is dissolved and mixed in the solution of the urea-modified polyester obtained after the reaction is complete.

The toner of the present invention can be manufactured by the following method but the method of manufacturing the toner is not limited thereto.

Method of Manufacturing Toner in Aqueous Medium

Suitable aqueous media for use in the present invention include water, and mixtures of water with a solvent which can be mixed with water. Specific examples of such a solvent include, but are not limited to, alcohols (e.g., methanol, isopropanol and ethylene glycol), dimethylformamide, tetrahydrofuran, cellosolves (e.g., methyl cellosolve), lower ketones (e.g., acetone and methyl ethyl ketone), etc.

In the present invention, a urea-modified polyester (UMPE) can be obtained by conducting a reaction between a reactive modified polyester such as a polyester prepolymer (A) having an isocyanate group and an amine (B) in an aqueous medium. As a method of stably forming a dispersion body formed of a reactive modified polyester and a prepolymer (A) such as a urea-modified polyester in an aqueous medium, there is a method in which a composition of a toner material formed of a reactive modified polyester and a prepolymer (A) such as a urea-modified polyester is added to an aqueous medium followed by dispersion using a shearing force.

A reactive modified polyester such as prepolymer (A) and other toner composition such as a coloring agent, a coloring agent master batch, a releasing agent and a non-modified polyester resin can be mixed in an aqueous medium when a dispersion body is formed. However, it is preferred that the toner compositions are preliminarily mixed and then the mixture is added to and dispersed in an aqueous medium.

As the dispersion method, high rotation speed shearing methods can be used. When the method is used, a rotor and a screen that is situated around the rotor spin round to opposite direction each other.

The amount of an aqueous medium is normally from 50 to 2,000 parts by weight and preferably from 100 to 1,000 parts by weight based on 100 parts by weight of a toner composition containing a polyester such as a urea modified polyester and a prepolymer (A). When the amount of an aqueous medium is too small, the dispersion stability of a toner composition can be degraded so that toner particles having a desired particle diameter are more difficult to obtain, or are not obtained. An amount of an aqueous medium that is excessively large is not preferred in light of economy. A dispersion agent can be used, if desired. It is preferred to use a dispersion agent in terms that the particle size distribution is sharp and the dispersion is stable.

Various kinds of dispersion agents are used for emulsification and dispersion of an oil phase in an aqueous phase.

Specific examples of such a dispersion agent include, but are not limited to a surface active agent, an inorganic particulate dispersion agent, a polymer particulate dispersion agent, etc.

Specific examples of the surface active agents include, but are not limited to, anionic dispersion agents, for example, alkylbenzene sulfonic acid salts, α-olefin sulfonic acid salts, and phosphoric acid salts; cationic dispersion agents, for example, amine salts (e.g., alkyl amine salts, aminoalcohol fatty acid derivatives, polyamine fatty acid derivatives and imidazoline), and quaternary ammonium salts (e.g., alkyltrimethyl ammonium salts, dialkyldimethyl ammonium salts, alkyldimethyl benzyl ammonium salts, pyridinium salts, alkyl isoquinolinium salts and benzethonium chloride); nonionic dispersion agents, for example, fatty acid amide derivatives, polyhydric alcohol derivatives; and ampholytic dispersion agents, for example, alanine, dodecyldi(aminoethyl) glycin, di(octylaminoethyle)glycin, and N-alkyl-N,N-dimethylammonium betaine.

Using a surface active agent having a fluoroalkyl group in an extremely small amount is effective for good dispersion. Preferred specific examples of the anionic surface active agents having a fluoroalkyl group include, but are not limited to, fluoroalkyl carboxylic acids having from 2 to 10 carbon atoms and their metal salts, disodium perfluorooctane sulfonyl glutamate, sodium 3-{omega-fluoroalkyl(C6-C11)oxy}-1-alkyl(C3-C4) sulfonate, sodium 3-{omega-fluoroalkanoyl (C6-C8)-N-ethylamino}-1-propanesulfonate, fluoroalkyl (C11-C20) carboxylic acids and their metal salts, perfluoroalkylcarboxylic acids and their metal salts, perfluoroalkyl(C4-C12)sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonyl glycin, monoperfluoroalkyl(C6-C16)ethylphosphates, etc.

Specific examples of the marketed products of such anionic surface active agents having a fluoroalkyl group include, but are not limited to, SURFLON®S-111, S-112 and S-113, which are manufactured by Asahi Glass Co., Ltd.; FRORARD® FC-93, FC-95, FC-98 and FC-129, which are manufactured by Sumitomo 3M Ltd.; UNIDYNE® DS-101 and DS-102, which are manufactured by Daikin Industries, Ltd.; MEGAFACE® F-110, F-120, F-113, F-191, F-812 and F-833 which are manufactured by Dainippon Ink and Chemicals, Inc.; ECTOP® EF-102, 103, 104, 105, 112, 123A, 306A, 501, 201 and 204, which are manufactured by Tohchem Products Co., Ltd.; FUTARGENT® F-100 and F150 manufactured by Neos; etc.

Specific examples of the cationic surface active agents having a fluoroalkyl group include, but are not limited to, primary or secondary aliphatic or secondary amino acids, aliphatic quaternary ammonium salts (for example, perfluoroalkyl(C6-C10)sulfoneamidepropyltrimethyl ammonium salts), benzalkonium salts, benzetonium chloride, pyridinium salts, and imidazolinium salts.

Specific examples of the marketed products of such catiotic surface active agents having a fluoroalkyl group include, but are not limited to, SURFLON® S-121 (from Asahi Glass Co., Ltd.); FRORARD® FC-135 (from Sumitomo 3M Ltd.); UNIDYNE® DS-202 (from Daikin Industries, Ltd.); MEGAFACE® F-150 and F-824 (from Dainippon Ink and Chemicals, Inc.); ECTOP® EF-132 (from Tohchem Products Co., Ltd.); FUTARGENT® F-300 (from Neos); etc.

In addition, a water hardly soluble inorganic dispersing agents can be used. Specific examples thereof include, but are not limited to, tricalcium phosphate, calcium carbonate, titanium oxide, colloidal silica and hydroxyapatite.

Particulate polymers have been confirmed to have the same effect as an inorganic dispersion agent.

Specific examples of the particulate polymers include, but are not limited to, particulate polymethyl methacylate (MMA) having a particle diameter of 1 and 3 μm, particulate polystyrene having a particle diameter of 0.5 and 2 μm, particulate styrene-acrylonitrile copolymers having a particle diameter of 1 μm, etc. Specific examples of the marketed particulate polymers include, but are not limited to, PB-200H (available from Kao Corp.), SGP (available from Soken Chemical & Engineering Co., Ltd.), TECHNOPOLYMER® SB (available from Sekisui Plastics Co., Ltd.), SPG-3G (available from Soken Chemical & Engineering Co., Ltd.), MICROPEARL® (available from Sekisui Fine Chemical Co., Ltd.), etc.

Furthermore, toner components can be stably dispersed in an aqueous medium by using a polymeric protection colloid in combinational use with the inorganic dispersing agents and particulate polymers mentioned above. Specific examples of such polymeric protection colloids include, but are not limited to, polymers and copolymers prepared using monomers, for example, acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g., acrylamide, methacrylamide and diacetoneacrylamide) and their methylol compounds, acid chlorides (e.g., acrylic acid chloride and methacrylic acid chloride), and homopolymers or copolymers having a nitrogen atom or an alicyclic ring having a nitrogen atom (e.g., vinyl pyridine, vinyl pyrrolidone, vinyl imidazole and ethylene imine).

In addition, polymers, for example, polyoxyethylene based compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters), and cellulose compounds, for example, methyl cellulose, hydroxyethyl cellulose and hydroxypropyl cellulose, can also be used as the polymeric protective colloid.

An organic solvent in which a polyester, for example, a urea-modified polyester and a prepolymer (A), is soluble can be used to decrease the viscosity of a medium dispersion containing a toner component. Using such a solvent is preferable because the particle size distribution can be sharp. The organic solvent is preferred to be volatile and have a boiling point lower than 100° C. since it is easy to remove such an organic solvent.

Specific examples thereof include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methylethyl ketone and methylisobutyl ketone. These can be used alone or in combination. Especially, aromatic series based solvent, for example, toluene and xylene, and halogenated hydrocarbons, for example, methylene chloride, 1,2-dichloroethane, chloroform and carbon tetrachloride, are preferred.

The content of the organic solvent is from 0 to 300 parts by weight, preferably from 0 to 100 parts by weight and more preferably from 25 to 70 parts by weight based on 100 parts by weight of a prepolymer (A). When such a solvent is used, the solvent is removed from the resultant product under normal pressure or a reduced pressure after the elongation and/or cross-linking reaction of a modified polyester (prepolymer) by an amine.

The cross-linking time and/or the elongation time is determined depending on the reactivity determined by the combination of the structure of the isocyanate group in a prepolymer (A) and an amine (B). The cross-linking time and/or the elongation time is in general from 10 minutes to 40 hours, and preferably from 2 to 24 hours. The reaction temperature is generally from 0 to 150° C., and preferably from 40 to 98° C. In addition, a known catalyst can be optionally used. Specific examples of such elongation agents and/or cross-linking agents include, but are not limited to, dibutyltin laurate and dioctyltin laurate. Specific examples of such an elongation agent and/or a cross-linking agent include, but are not limited to, the amines (B) mentioned above.

In the present invention, prior to removal of solvent from the liquid dispersion (reaction liquid) after elongation and/or cross-linking reaction, the solvent of the liquid dispersion is preferably removed at 10 to 50° C. This stirring of liquid before the solvent removal causes toner particles to have an irregular form. Also, Dv and Dn can be controlled by, for example, adjusting the characteristics of resin particulates and the addition amount.

The toner of the present invention has a ratio (Dv/Dn) of the volume average particle diameter (Dv) to the number average particle diameter (Dn) of from 1.00 to 1.30. This makes the toner of the present invention suitable for obtaining quality images with a high definition. Furthermore, when the toner is used in a two component developing agent and replenished for an extended period of time, the variance of the particle diameter of the toner in the developing agent is reduced. Also good developability is maintained even when the toner is repeatedly stirred in a development device for an extended period of time. When the ratio (Dv/Dn) is too large, particles diameters of individual toner particles greatly vary, thereby making the behavior of the toner vary during development and degrading the reproducibility of minute dots. Therefore, quality images are not obtained. The ratio (Dv/Dn) is preferably from 1.00 to 1.20, which ameliorates the quality of images.

The toner of the present invention preferably has a volume average particle diameter of from 3.0 to 7.0 μm. In general, toner having a small particle diameter is advantageous to obtain quality images with a high definition but disadvantageous in terms of the transferability and the cleaning property. When toner has an excessively small volume average particle diameter, the toner in a two component developing agent tends to adhere to the surface of carrier particles during stirring in the development device for an extended period of time, resulting in deterioration of chargeability of the carrier. When the toner is used as a single component developing agent, filming of toner on the development roller and adhesion of the toner to a member such as a blade for regulating the toner layer thickness tend to occur. Furthermore, these phenomena relate to the content ratio of fine powder. When toner particles having a particle diameter of not greater than 2 μm are contained in an amount of not less than 20% by number, such toner easily attaches to carrier particles and has a negative impact on stabilization of chargeability at a high level. To the contrary, when the toner particle diameter is too large, quality images with high definition tend to be hardly obtained and the particle diameter of toner tends to greatly vary when the toner is replenished. Additionally, it is found that this is true when the ratio (Dv/Dn) is larger than 1.30.

The relationship between the toner shape and the transferability is described first. When a full color photocopier is used in which multicolor images are transferred, the amount of toner on the image bearing member increases in comparison with the case in which a single color (black) photocopying toner is used in a monochrome photocopier. Thus, it is difficult to improve the transfer efficiency by simply using a typical irregularized toner. Furthermore, a typical irregularized toner tends to cause adhesion to or filming on the surface of an image bearing member and/or an intermediate transfer body due to a shear stress or abrasion force between the image bearing member and a cleaning member, between an intermediate transfer body and a cleaning member, and/or between the image bearing member and the intermediate transfer body, which leads to deterioration of the transfer efficiency. When a full color image is formed, a four color toner image is hardly uniformly transferred. Furthermore, when an intermediate transfer body is used, problems such as color unevenness and color balance tend to arise, resulting in difficulty in continuous production of quality full color images.

Toner particles having a circularity having 0.950 or lower is preferably contained in an amount of 20 to 80% based on all the toner particles in terms of the balance between blade cleaning and transfer efficiency. Cleaning and transfer efficiency greatly relate to blade materials and contact condition of a blade. In addition, since transfer varies depending on process conditions, toner can be suitably designed in the range specified above. When toner particles having a circularity of 0.950 or lower are contained in an excessively small amount, blade cleaning may be hardly effective. To the contrary, when toner particles having a circularity of 0.950 or lower are contained in an excessively large amount, the transferability described above can tend to deteriorate. This phenomenon is considered to occur because the toner has an irregular form so that the toner does not move smoothly during transfer (from the surface of an image bearing member to a transfer medium, the surface of an image bearing member to an intermediate transfer belt, a primary intermediate transfer belt to a secondary intermediate transfer belt, etc.) and the behavior among toner particles varies, resulting in non-uniform and low transfer efficiency. Furthermore, charging of toner starts to be unstable and the toner particles tend to be brittle. In addition, toner particles in a developing agent tend to be broken into fine powder, which may cause deterioration of durability of the developing agent. Thus, toner particles having a circularity having 0.950 or lower is preferably contained in an amount of 20 to 80% based on all the toner particles In the present invention, it is preferable that the toner particles have a circularity of 0.93 to 0.97 on average.

When the toner particles have a circularity of 0.93 to 0.97 on average, the toner has advantages to provide an excellent reproducibility in dot by image forming, an excellent developing characteristic, an excellent transcription property and an excellent cleaning characteristic because of toner's shape. When the toner particles have a circularity smaller than 0.93, a reproducibility in dot by image forming is insufficient because the shape of toner tends to be far from a sphere. And also a transcription property is decrease, because the number of contact points is increase and mold release characteristics decrease.

Particle Having Particle Diameter of 2 μm or Less and Circularity

The particle ratio of the toner having a particle diameter of 2 μm or less and the average circularity thereof can be measured by using a flow particle image analyzer (FPIA-1000, manufactured by Sysmex Corporation). A specific method is: Add 0.1 to 0.5 ml of a surface active agent, preferably, alkylbenzene sulfonate salt, to 100 to 150 ml of water in a container from which impurity has been removed in advance; Add about 0.1 to about 0.5 g of a sample material thereto to obtain a liquid suspension in which the sample material is dispersed; subsequent to about 1 to 3 minutes dispersion treatment of the liquid suspension by an ultrasonic dispersing device, measure the form and distribution of the toner by the device specified above while the density of the liquid dispersion is presumed to be 3,000 to 10,000 particles/μl.

Toner Particle Size

The average particle diameter and size distribution of a toner can be measured by Coulter Counter method.

Specific examples of devices measuring particle size distribution of toner particles include COULTER COUNTER TA-II and COULTER MULTI-SIZER II (both are manufactured by Beckman Coulter Inc.). COULTER COUNTER MULTI-SIZER TA-II is connected to an interface (manufactured by the institute of Japanese Union of Science and Engineers) and a PC9801 personal computer (manufactured by NEC Corporation) to measure the number distribution and the volume distribution.

The measuring method is described below.

(1) Add 0.1 to 5 ml of a surface active agent (preferably a salt of an alkyl benzene sulfide) as a dispersing agent to 100 to 150 ml of an electrolytic aqueous solution. The electrolytic aqueous solution is an about 1% NaCl aqueous solution prepared by using primary NaCl (e.g., ISOTON-II®, manufactured by Beckman Coulter Inc.).

(2) Add 2 to 20 mg of a measuring sample to the electrolytic aqueous solution.

(3) The electrolytic aqueous solution in which the measuring sample is suspended is subject to a dispersion treatment for about 1 to 3 minutes with an ultrasonic disperser.

(4) Measure the volume and the number of toner particles or toner with the aperture set to 100 μm for the measuring device mentioned above to calculate the volume distribution and the number distribution.

The whole range is a particle diameter of from 2.00 to not greater than 40.30 μm and the number of the channels is 13. These channels are: from 2.00 to not greater than 2.52 μm; from 2.52 to not greater than 3.17 μm; from 3.17 to not greater than 4.00 μm; from 4.00 to not greater than 5.04 μm; from 5.04 to not greater than 6.35 μm; from 6.35 to not greater than 8.00 μm; from 8.00 to not greater than 10.08 μm; from 10.08 to not greater than 12.70 μm; from 12.70 to not greater than 16.00 μm, from 16.00 to not greater than 20.20 μm; from 20.20 to not greater than 25.40 μm; from 25.40 to not greater than 32.00 μm; and from 32.00 to not greater than 40.30 μm. The volume average particle diameter (Dv) based on volume obtained by the volume distribution and the number average particle diameter (Dn) obtained by the number distribution related to the present invention, and the ratio thereof (Dv/Dn) are obtained.

The toner of the present invention can be mixed with a magnetic carrier to be used as a two-component developing agent. The density of the toner to the carrier is preferably from 1 to 10% by weight.

Suitable magnetic carriers for use in a two component developer include, but are not limited to, known carrier materials such as iron powders, ferrite powders, magnetite powders, and magnetic resin carriers, which have a particle diameter of from about 20 to about 200 μm. The surface of the carriers may be coated by a resin.

It is preferred to coat the surface of the carriers with a resin layer. Specific examples of such resins include, but are not limited to, amino resins such as urea-formaldehyde resins, melamine resins, benzoguanamine resins, urea resins, and polyamide resins, and epoxy resins. In addition, vinyl or vinylidene resins such as acrylic resins, polymethylmethacrylate resins, polyacrylonitirile resins, polyvinyl acetate resins, polyvinyl alcohol resins, polyvinyl butyral resins, polystyrene resins, styrene-acrylic copolymers, halogenated olefin resins such as polyvinyl chloride resins, polyester resins such as polyethylene terephthalate resins and polybutylene terephthalate resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, copolymers of tetrafluoroethylene, vinylidenefluoride and other monomers including no fluorine atom, and silicone resins.

If desired, an electroconductive powder can be contained in the toner. Specific examples of such electroconductive powders include, but are not limited to, metal powders, carbon blacks, titanium oxide, tin oxide, and zinc oxide. The average particle diameter of such electroconductive powders is preferably not greater than 1 μm. When the particle diameter is too large, controlling the resistance of the resultant toner tends to be difficult.

The toner of the present invention can also be used as a one-component magnetic developer or a one-component non-magnetic developer.

An embodiment of the image formation by the image forming apparatus of the present invention is described with reference to FIG. 1. The tandem image forming apparatus illustrated in FIG. 1 is a tandem type color image forming apparatus. The tandem type image forming apparatus includes a main body 150, a paper feeder table 200, a scanner 300 and an automatic document feeder (ADF) 400.

The main body 150 has an intermediate transfer body 1050 having an endless belt form arranged in the center of the main body 150. The intermediate transfer body 1050 is suspended over supporting rollers 1014, 1015 and 1016 and can rotate clockwise in FIG. 1. An intermediate transfer body cleaning device 1017 is arranged in the vicinity of the supporting roller 1015 to remove the toner remaining on the intermediate transfer body 1050. A tandem type development unit 120 is provided along the intermediate transfer body 1050 and includes four image formation devices 1018 of yellow, cyan, magenta, and black arranged along the moving direction of the intermediate transfer body 1050 while opposing the intermediate transfer body 1050 suspended over the supporting rollers 1014 and 1015. An irradiation device 1021 is situated close to the tandem type development unit 120. A secondary transfer device 1022 is provided on the opposite side of the tandem type development unit 120 and includes a secondary transfer belt 1024 (an endless belt) and a pair of rollers 1023 suspending the secondary transfer belt 1024. A transfer sheet being transferred on the secondary transfer belt 1024 can contact with the intermediate transfer body 1050. A fixing device 1025 is arranged in the vicinity of the secondary transfer device 1022 and includes a fixing belt 1026 and a pressing roller 1027 pressed thereby.

Also, a sheet reversing device 28 is arranged near the secondary transfer device 1022 and the fixing device 1025 to reverse the side of the transfer sheet for duplex printing.

Next, full color image formation by the tandem type development unit 120 is described. An original is set on a manual table 130 of the automatic document feeder 400 or a contact glass 1032 of a scanner 300 after the automatic document feeder 400 is open and then the automatic document feeder 400 is closed.

When a start switch (not shown) is pressed, the scanner 300 is driven and a first carrier 1033 and a second carrier 1034 travel immediately in the case in which the original is set on the contact glass 1032 or after the original is transferred to the contact glass 1032 in the case in which an original is set on the automatic document feeder 400. The original is irradiated with light from the light source by the first carrier 1033 and the reflected light from the original is reflected by a mirror of the second carrier 1034. Then, the reflected light is received at a scanning sensor 1036 by way of an image focus lens 1035 to read the color original (color image) and obtain image information of black, yellow, magenta and cyan.

Figure 2:
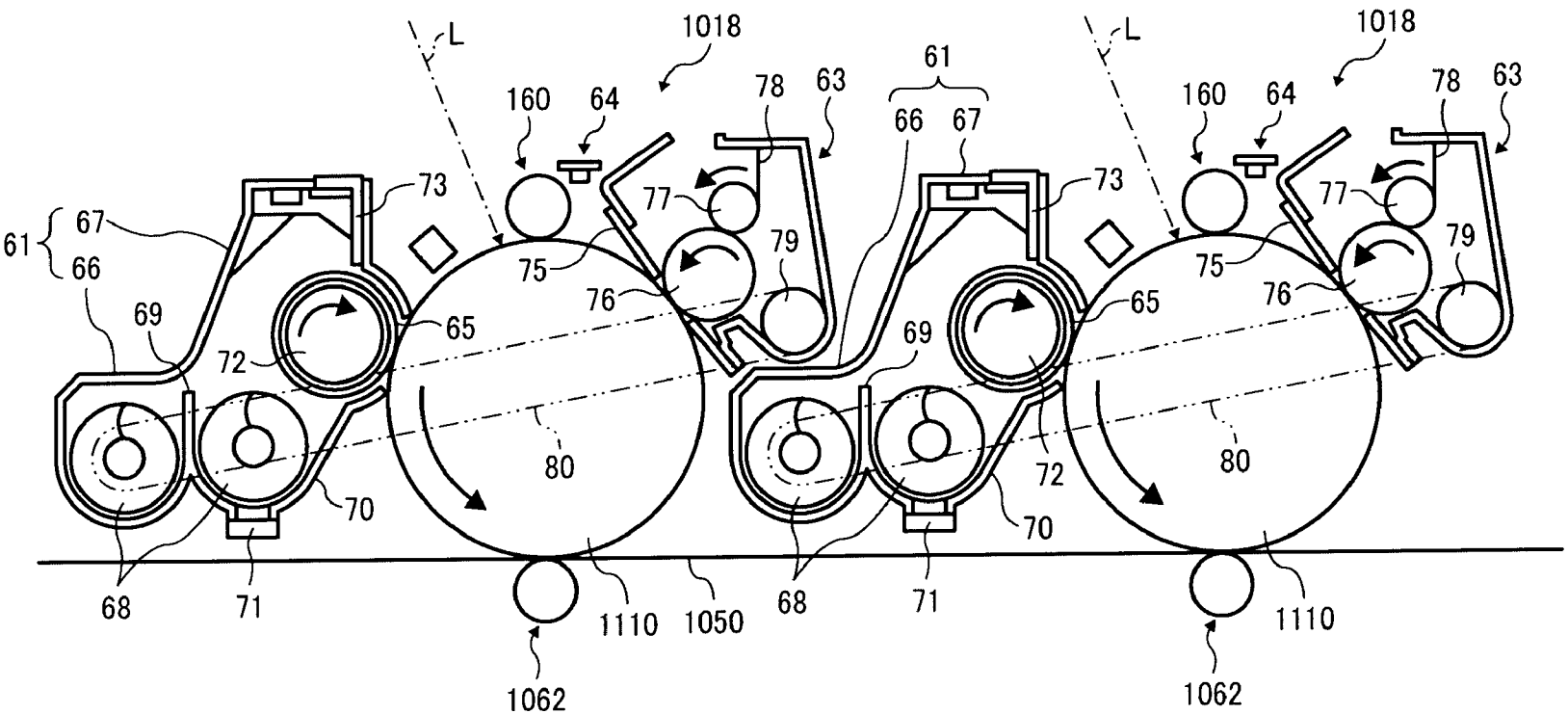
FIG. 2 is a diagram illustrating an enlarged portion of the image forming apparatus of FIG. 1.

Each image information of black, yellow, magenta and cyan in the tandem type development unit 120 is relayed to each image formation device 1018 (image formation device for black, image formation device for yellow, image formation device for magenta and image formation device for cyan) and each toner image of black, yellow, magenta and cyan is formed by each image formation device. Each image formation device 1018 (image formation device for black, image formation device for yellow, image formation device for magenta and image formation device for cyan) in the tandem type image forming apparatus irradiates the corresponding latent electrostatic image bearing members 1010 (latent electrostatic image bearing member 1010K for black, latent electrostatic image bearing member 1010Y for yellow, latent electrostatic image bearing member 1010M for magenta and latent electrostatic image bearing member 1010C for cyan) with light L (illustrated in FIG. 2), and uniformly charges the charging device 160 which uniformly charges the latent electrostatic image bearing member 1010, an irradiating device to irradiate the latent electrostatic image bearing member 1010 with light to form a latent electrostatic image on the latent electrostatic image bearing member 1010 corresponding to each color image information, a development device 61 which develops the latent electrostatic image with each color toner (black toner, yellow toner, magenta toner, and cyan toner) to form each color toner image, a transfer charging device 1062 to transfer the toner image to the intermediate transfer body 1050, a cleaning device 63 and a discharging device 64. Each single color toner image (black image, yellow image, magenta image and cyan image) can be formed according to corresponding color image information. The thus formed black image, yellow image, magenta image and cyan image on the latent electrostatic image bearing member 1010K, the latent electrostatic image bearing member 1010Y, the latent electrostatic image bearing member 1010M, and the latent electrostatic image bearing member 1010C, respectively, are sequentially transferred (primarily transferred) to the intermediate transfer body 1050 rotationally driven by the supporting rollers 1014, 1015 and 1016. The black image, the yellow image, the magenta image and the cyan image are overlapped on the intermediate transfer body 1050 to obtain a synthesized color image (color transfer image).

One of paper feeder rollers 142 in the paper feeder table 200 is selectively rotated to feed sheets (recording medium) from one of banked paper feeder cassettes 144 and then a separation roller 145 separates sheets one by one and sends it out to a paper feeding path 146. The sheet is guided to a paper feeding path 148 in the main body 150 and stuck at the registration rollers 1049. The registration rollers 1049 are grounded in general but can be used with a bias applied to remove paper dust of a sheet. The registration rollers 1049 are rotated in synchronization with the synthesized color image (transferred color image) and set out the sheet (recording medium) between the intermediate transfer body 1050 and the secondary transfer device 1022. The secondary transfer device 1022 (secondarily) transfers the synthesized color image (transferred color image) to the sheet (recording medium). The toner remaining on the intermediate transfer body 1050 after image transfer is removed by an intermediate transfer body cleaning device 1017.

The sheet (recording medium) to which the color image has been transferred is moved to the fixing device 1025 by the secondary transfer device 1022. The synthesized color image (transferred color image) is fixed on the sheet (recording medium) upon application of heat and pressure by the fixing device 1025. Thereafter, the sheet (recording medium) is discharged to and stuck on a discharging tray 1057 by discharging rollers 1056 by way of a switching claw 1055 or reversed by the sheet reverse device 1028 by way of the switching claw 1055, guided back to the transfer point followed by image formation on the reverse side, and discharged to and stuck on the discharging tray 1057 by the discharging roller 1056.

Having generally described preferred embodiments of this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

The present invention is more described in detail with reference to Examples but is not limited thereto.

Manufacturing of Polyester 690 parts of an adduct of bisphenol A with 2 mol of ethylene oxide and 335 parts of terephthalic acid are placed in a reaction container equipped with a condenser, a stirrer and a nitrogen introduction tube to conduct a polycondensation reaction at 210° C. for 10 hours under normal pressure. Next, the reaction is continued for 5 hours with a reduced pressure of 10 to 15 m Hg. Subsequent to cooling down, Polyester (1) is obtained. The weight average particle diameter of the Polyester (1) of the obtained Polyester (1) is 6,000, the acid value thereof is 10 KoHmg/g and the glass transition temperature thereof is 48° C.

Manufacturing of Prepolymer 795 parts of an adduct of bisphenol A with 2 mole of ethylene oxide, 200 parts of isophthalic acid, 65 parts of terephthalic acid and 2 parts of dibutyltin oxide are placed in a reaction container equipped with a condenser, a stirrer and a nitrogen introduction tube, to conduct a reaction at 210° C. for 8 hours. Next, the reaction is continued for 5 hours with a reduced pressure of 10 to 15 mmHg while dehydrating. Subsequent to cooling down to 80° C., the resultant is reacted with 170 parts of isophorone diisocyanate in ethyl acetate for 2 hours and thus Prepolymer (1) is obtained.

A weight average molecular weight of the obtained Prepolymer (1) is 5,000.

Manufacturing of Oil Phase 170 parts of 35% ethyl acetate dispersions of carnauba wax, 120 parts of polyester (1), 20 parts of PY155 (manufactured by Clariant, Ltd.), 70 parts of ethyl acetate and 2 parts of Isophorone diamine are placed in a container equipped with a stirrer followed by stirring dissolving and mixing for 2 hours, after that circulating mixing for 1 hour is applied using high efficiency dispersion machine Ebaramiledann (manufactured by Ebara Corporation) to obtain Oil phase (1).

An acid value of the obtained oil phase (1) is 4.5 KOHmg/g.

In addition, 25 parts of Prepolymer (1) and 25 parts of ethyl acetate are placed in other container equipped with a stirrer followed by stirring dissolving and mixing for 2 hours to obtain Oil phase (2).

Preparation of Aqueous Medium 945 parts of water, 40 parts of 20% water dispersions of styrene-methacrylic acid-acrylic acid butyl copolymer, 160 parts of 50% water solution of sodium dodecyldiphenylether disulfonate (EREMINOR MON-7, manufactured by Sanyo Chemical Industries, Ltd.), and 90 parts of ethyl acetate are placed in a container equipped with a stirrer followed by stirring to obtain Aqueous phase (1).

Toner Manufacturing Example

Example 1

Oil phase (1) with the rate of speed of 350 g/min., Oil phase (2) with the rate of speed of 40 g/min. and Aqueous phase (1) with the rate of speed of 600 g/min. are supplied in a CLEARMIX W motion (manufactured by M Technique Co., Ltd.) to obtain Emulsion slurry (1).

The number of times of passing by the emulsifier is once. In this process for supplying, the speed of the rotor is 20 (m/s) and the speed of the screen is 20 (m/s). Obtained Emulsion slurry (1) is placed in a container equipped with a stirrer and a thermometer is conducted at 30° C. for 8 hours for a de-solvent to obtain Slurry (1).

Washing and Drying 100 parts of Slurry (1) are filtered under a reduced pressure. Then the following is performed.

(1) 100 parts of deionized water are added to the thus prepared filtered cake and the mixture is mixed for 10 minutes by a TK HOMOMIXER at 12,000 rpm and then filtered;
(2) 100 parts of a 10% aqueous solution of sodium hydroxide are added to the filtered cake prepared in (1) and the mixture is mixed for 30 minutes by a TK HOMOMIXER at 12,000 rpm and then filtered under a reduced pressure;
(3) 100 parts of a 10% hydrochloric acid are added to the filtered cake prepared in (2) and the mixture is mixed by a TK HOMOMIXER and then filtered; and
(4) 300 parts of deionized water are added to the filtered cake prepared in (3) and the mixture is mixed by a TK HOMOMIXER and then filtered, wherein this washing is repeated twice to prepare Filtered cake (1).

Filtered cake (1) is dried at 40° C. for 48 hours using a circulating drier. The dried cake is sieved using a screen having openings of 75 μm. 100 parts of the obtained mother toner particles, 0.5 parts of hydrophobic silica (hexamethyldisilazane surface treated, specific surface area: 200 $m^2/g$) and 0.5 parts of hydrophobic rutile type titan oxide (isobutyl trimethoxysialne surface treated; average primary particle diameter: 0.02 μm) are mixed in a HENSCHEL MIXER to prepare Toner (1).

Example 2

Oil phase (1) with the rate of speed of 350 g/min., Oil phase (2) with the rate of speed of 40 g/min. and Aqueous phase (1) with the rate of speed of 600 g/min. are supplied in a CLEARMIX W motion (manufactured by M Technique Co., Ltd.) to obtain Emulsion slurry (2). The number of times of passing by the emulsifier is once. In this process for supplying, the speed of the rotor is 35 (m/s) and the speed of the screen is 35 (m/s). Obtained Emulsion slurry (2) is placed in a container equipped with a stirrer and a thermometer is conducted at 30° C. for 8 hours for a de-solvent to obtain Slurry (2) followed by the washing and drying treatment and external additive treatment as in Example 1 to obtain [Toner 2].

Example 3

Oil phase (1) with the rate of speed of 350 g/min., Oil phase (2) with the rate of speed of 40 g/min. and Aqueous phase (1) with the rate of speed of 600 g/min. are supplied in a CLEARMIX W motion (manufactured by M Technique Co., Ltd.) to obtain Emulsion slurry (3). The number of times of passing by the emulsifier is once. In this process for supplying, the speed of the rotor is 40 (m/s) and the speed of the screen is 40 (m/s). Obtained Emulsion slurry (3) is placed in a container equipped with a stirrer and a thermometer is conducted at 30° C. for 8 hours for a de-solvent to obtain Slurry (3) followed by the washing and drying treatment and external additive treatment as in Example 1 to obtain [Toner 3].

Example 4

Oil phase (1) with the rate of speed of 350 g/min., Oil phase (2) with the rate of speed of 40 g/min. and Aqueous phase (1) with the rate of speed of 600 g/min. are supplied in a CLEARMIX W motion (manufactured by M Technique Co., Ltd.) to obtain Emulsion slurry (4). The number of times of passing by the emulsifier is once. In this process for supplying, the speed of the rotor is 14 (m/s) and the speed of the screen is 14 (m/s). Obtained Emulsion slurry (4) is placed in a container equipped with a stirrer and a thermometer is conducted at 30° C. for 8 hours for a de-solvent to obtain Slurry (4) followed by the washing and drying treatment and external additive treatment as in Example 1 to obtain [Toner 4].

Comparative Example 1

Oil phase (1) with the rate of speed of 350 g/min., Oil phase (2) with the rate of speed of 40 g/min. and Aqueous phase (1) with the rate of speed of 600 g/min. are supplied in a pipeline homosexual mixer (manufactured by PRIMIX Corporation) to obtain Emulsion slurry (5). The number of times of passing by the emulsifier is once. In this process for supplying, the peripheral speed is 16 (m/s). Obtained Emulsion slurry (5) is placed in a container equipped with a stirrer and a thermometer is conducted at 30° C. for 8 hours for a de-solvent to obtain Slurry (5) followed by the washing and drying treatment and external additive treatment as in Example 1 to obtain [Toner 5].

Comparative Example 2

Oil phase (1) with the rate of speed of 350 g/min., Oil phase (2) with the rate of speed of 40 g/min. and Aqueous phase (1) with the rate of speed of 600 g/min. are supplied in a pipeline homosexual mixer (manufactured by PRIMIX Corporation) to obtain Emulsion slurry (6). The number of times of passing by the emulsifier is once. In this process for supplying, the peripheral speed is 22 (m/s). Obtained Emulsion slurry (6) is placed in a container equipped with a stirrer and a thermometer is conducted at 30° C. for 8 hours for a de-solvent to obtain Slurry (6) followed by the washing and drying treatment and external additive treatment as in Example 1 to obtain [Toner 6].

Image Granularity, Vividness and Sharpness

Image granularity, vividness and sharpness are evaluated by observing a single color photograph printed by a digital full color photocopier (imagioColor2800, manufactured by Ricoh Co., Ltd.) with naked eyes. The evaluation criteria are as follows:

E (Excellent): as good as offset printing

G (Good): slightly inferior to offset printing

B (Bad): significantly worse than offset printing

W (Worse): same as typical electrophotographic image (Extremely bad)

The results of each Example and Comparative Example are shown in Table 1.

TABLE 1

| | Toner | Dv | Dv/Dn | Granularity |
|---|---|---|---|---|
| Example 1 | Toner 1 | 4.8 | 1.11 | E |
| Example 2 | Toner 2 | 5.3 | 1.13 | E |
| Example 3 | Toner 3 | 6.0 | 1.17 | G |
| Example 4 | Toner 4 | 6.8 | 1.18 | G |
| Comparative Example 1 | Toner 5 | 8.3 | 1.38 | W |
| Comparative Example 2 | Toner 6 | 7.6 | 1.31 | B |

This document claims priority and contains subject matter related to Japanese Patent Application No. 2008-121840, filed on May 8, 2008, the entire contents of which are incorporated herein by reference. In addition, all references, patents, applications, tests, standards, documents, publications, brochures, texts, articles, etc. mentioned herein are incorporated herein by reference.

As used herein, the words "a" and "an" and the like carry the meaning of "one or more".

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A method of manufacturing a toner comprising:

dispersing at least a binder resin, a coloring agent and a releasing agent in an organic solvent to obtain an oil phase;

dispersing the oil phase in an aqueous medium with a shearing force to obtain a dispersion emulsion;

wherein the shearing force is provided by a countercurrent system comprising a screen or vessel that is situated around a rotor arranged such that the screen or vessel spins in a direction opposite to the direction that the rotor spins.

2. The method of manufacturing a toner according to claim 1, wherein a circumferential speed in total of the rotor and the screen or vessel is from 30 (m/S) to 70 (m/S).

3. The method of manufacturing a toner according to claim 1, comprising:

dispersing a binder resin precursor that comprises a modified polyester, a coloring agent, and a releasing agent in an organic solvent to obtain an oil phase;

dissolving a compound which elongates or cross-links with the precursor in the oil phase;

dispersing the oil phase in an aqueous medium that comprises a particulate dispersion agent with said shearing force to obtain a dispersion emulsion;

conducting cross-linking reaction and elongation reaction of the precursor in the emulsified liquid dispersion; and removing the organic solvent.

4. The method of manufacturing a toner according to claim 1, wherein the binder resin comprises a polyester resin.

5. The method of manufacturing a toner according to claim 4, wherein a content of the polyester resin in the binder resin ranges from 50 to 100% by weight based on total weight of binder resin.

6. The method of manufacturing a toner according to claim 4, wherein a weight average molecular weight of a portion of the polyester resin which is soluble in tetrahydrofuran (THF) ranges from 1,000 to 30,000.

7. The method of manufacturing a toner according to claim 4, wherein the polyester resin is a polyester resin having an acid group which has an acid value of from 1.0 to 50.0 (KOHmg/g).

8. The method of manufacturing a toner according to claim 4, wherein the polyester resin has a glass transition temperature of from 35 to 65° C.

9. The method of manufacturing a toner according to claim 3, wherein the precursor is a polymer having a portion reactive with a compound having an active hydrogen and a weight average molecular weight of the polymer having a portion reactive with a compound having an active hydrogen ranges from 3,000 to 20,000.

10. The method of manufacturing a toner according to claim 1, wherein a laminar inorganic mineral having ions between layers in which at least part of the ions are modified by an organic ion is dissolved or dispersed in the oil phase.

11. The method of manufacturing a toner according to claim 1, wherein the toner has an acid value of from 0.5 to 40.0 (KOHmg/g).

12. The method of manufacturing a toner according to claim 1, wherein the toner has a glass transition temperature of from 40 to 70° C.

13. The method of manufacturing a toner according to claim 1, wherein the toner has a volume average particle diameter of from 3 to 7 μm.

14. The method of manufacturing a toner according to claim 1, wherein the toner has a ratio (Dv/Dn) of a volume average particle diameter (Dv) to a number average particle diameter (Dn) of 1.30 or lower.

15. The method of manufacturing a toner according to claim 1, wherein the number of toner particles produced having a particle diameter of 2 μm or smaller is not greater than 20% by number.

16. The method of manufacturing a toner according to claim 1, wherein the toner produced has a circularity of 0.93 to 0.97 on average.

17. The method of manufacturing a toner according to claim 1, wherein said countercurrent system comprises a screen.

18. The method of manufacturing a toner according to claim 1, wherein said countercurrent system comprises a vessel.

* * * * *